US009321604B2

(12) United States Patent
Torres Martinez

(10) Patent No.: US 9,321,604 B2
(45) Date of Patent: Apr. 26, 2016

(54) AUTOMATIC SPLICER FOR CONTINUOUS SUPPLY OF LAMINAR STRIPS

(76) Inventor: Manuel Torres Martinez, Pamplona (ES)

( * ) Notice: Subject to any disclaimer, the term of this patent is extended or adjusted under 35 U.S.C. 154(b) by 177 days.

(21) Appl. No.: 14/115,987

(22) PCT Filed: Apr. 3, 2012

(86) PCT No.: PCT/ES2012/000085
§ 371 (c)(1),
(2), (4) Date: Nov. 6, 2013

(87) PCT Pub. No.: WO2012/152960
PCT Pub. Date: Nov. 15, 2012

(65) Prior Publication Data

US 2014/0060745 A1 Mar. 6, 2014

(30) Foreign Application Priority Data

May 6, 2011 (ES) ..... 201100492

(51) Int. Cl.
*B65H 19/18* (2006.01)

(52) U.S. Cl.
CPC ..... *B65H 19/18* (2013.01); *B65H 19/1836* (2013.01); *B65H 2301/46115* (2013.01); *B65H 2301/46414* (2013.01); *B65H 2403/513* (2013.01); *B65H 2408/2211* (2013.01); *B65H 2701/1762* (2013.01)

(58) Field of Classification Search
CPC ..... B65H 19/1836; B65H 2408/221; B65H 2408/2211
See application file for complete search history.

(56) References Cited

U.S. PATENT DOCUMENTS

| | | | | | |
|---|---|---|---|---|---|
| 3,841,944 | A * | 10/1974 | Harris, Jr. | | 156/504 |
| 4,113,197 | A | 9/1978 | Harrington et al. | | |
| 4,169,752 | A * | 10/1979 | Tokuno | | 156/157 |
| 4,492,609 | A * | 1/1985 | Blom | B65H 19/10 | 156/353 |
| 4,564,413 | A * | 1/1986 | Murakami | B65H 19/1836 | 156/504 |
| 4,695,007 | A * | 9/1987 | Muto | B65H 19/1836 | 156/502 |
| 5,171,396 | A * | 12/1992 | Rank et al. | | 156/502 |
| 6,451,145 | B1 * | 9/2002 | Forbes | | 156/159 |
| 6,719,239 | B2 * | 4/2004 | Suzuki | B65H 19/14 | 156/504 |
| 6,786,264 | B1 * | 9/2004 | Torres Martinez | | 156/504 |
| 6,966,961 | B2 * | 11/2005 | Adami | | 156/159 |

FOREIGN PATENT DOCUMENTS

| | | | |
|---|---|---|---|
| EP | 1422175 | A2 | 5/2004 |
| EP | 1770038 | A2 | 4/2007 |
| ES | 2013482 | A6 | 5/1990 |
| ES | 2184573 | A1 | 4/2003 |
| ES | 2234357 | A1 | 6/2005 |

* cited by examiner

*Primary Examiner* — Mark A Osele
(74) *Attorney, Agent, or Firm* — Lucas & Mercanti, LLP

(57) ABSTRACT

The present invention relates to an automatic splicer for the continuous supply of laminar strips, comprising a reel holder for incorporating two reels that can be positioned alternately in a feed position for feeding to an application process and in a standby position, there being above the reel holder a guide rail on which a splicer head that can move in a movement projected towards a splicing zone is mounted, carrying the laminar strip of a reel arranged in standby for splicing it with the laminar strip of the feed reel during a joint movement of said laminar strips.

8 Claims, 28 Drawing Sheets

AUTOMATIC SPLICER FOR CONTINUOUS SUPPLY OF LAMINAR STRIPS

CROSS-REFERENCE TO RELATED APPLICATIONS

This application is a 371 of PCT/ES2012/000085 filed Apr. 3, 2012, which in turn claims the priority of ES P201100492 filed May 6, 2011, the priority of both applications is hereby claimed and both applications are incorporated by reference herein.

TECHNICAL FIELD

The present invention relates to the supply of laminar strips to laminar strip application processes, proposing an automatic splicer which advantageously allows joining laminar strips from two successive feed reels, keeping the supply to the application process constant.

STATE OF THE ART

In specific processes such as corrugated cardboard manufacture and other applications in which sheets of paper or other similar materials are used as raw material, it is of interest to maintain continuous feeding to the application process, such that said process does not have to be stopped when the feed reels for feeding the laminar strips that are being supplied run out.

To that end, reel holders having two feed reels for feeding the laminar strip to be supplied to the application process are provided, such that while feeding is performed from one of the reels, the other reel is in standby so that when the reel from which the feeding is performed runs out, feeding will be established from the reel that is in standby.

For joining the laminar strip from the feed reel that is running out with the laminar strip from the reel that is in standby, splicer mechanisms which act when the reel performing the feeding runs out are in turn provided, cutting the laminar strip from said feed reel and joining the end of that laminar strip with the front end of the laminar strip of the new reel that is in standby, so that the feeding continues with supply from the new reel. Such splicers are those described, for example, in patents ES2013482, ES2184573 and ES2234357 belonging to the applicant of the present invention.

The junction splice between the laminar strips of the feed reel that is running out and the new reel that is in standby in order to continue the feeding requires joining the two laminar strips without there being relative movement between the strips during junction splicing, which is performed with conventional splicer solutions by stopping the rotation of the feed reel that is running out, which requires slowing down the rotation of said feed reel that is running out until the feed reel stops, and after splicing speeding up the rotation of the new feed reel to the operating rotating speed of the feeding process.

In those conditions, in order to keep the supply of the laminar strip to the application process constant when splicing the laminar strip of the reel that is running out and the laminar strip of the reel that will continue the feeding, a variable-path storage having a variable path for the laminar strip is arranged at the outlet to the feeding process, such that by means of varying the path of the storage for the laminar strip, said storage keeps the supply to the application process constant during the splicing process.

With said use of a variable-path storage, speeds for continuous feeding to the application process up to the order of 800 meters per minute have been achieved, but to increase this speed very large variable-path storages would be necessary, and there would still be problems with certain laminar strips, such as sheets of low grammage paper or tissue paper, given the stress that the laminar strip would have to withstand for speeding up the new feed reels from zero speed after splicing.

OBJECT OF THE INVENTION

The invention proposes an automatic splicer provided with an arrangement and means which allow splicing laminar strips precisely and effectively, with the supply of said laminar strips to the application process at greater speeds than with the known solutions, without the drawbacks thereof.

This splicer object of the invention comprises a rotary reel holder having two reel supports that can be positioned alternately in a feed position and in a standby position, said reel holder being arranged below a guide rail in which there is incorporated in movement assembly a splicer head that can move between a preparation position for preparing the laminar strip from the reel in standby and a position for splicing said laminar strip of the reel in standby with the laminar strip of the reel performing the feeding, the splicer head having an action of being projected from a standby position to a splicing zone for splicing the two laminar strips to be joined, whereas the laminar strip that is supplied to the application process passes, after the splicing zone, through a variable-path storage.

The splicer head comprises a body established in sliding assembly on the movement guide rail and two parallel rollers which are synchronized in rotational movement, which are incorporated in a carriage that can have vertical elastic movement on the body of the head, one of the rollers being provided with a clamping device, whereas a cutting mechanism which can in turn have vertical elastic movement on the body of the head is arranged between the two rollers.

In the splicing zone, the laminar strip that is supplied to the application process passes over a support located below the moving carriage of the splicer head, said support being formed by two consecutive continuous bands, whereas there are arranged above the moving carriage of the splicer head ramps provided for contacting the carriage having the rotary rollers and the cutting mechanism of said splicer head, respectively.

A splicer is thus obtained which allows supplying a laminar strip from a feed reel incorporated in one of the supports of the reel holder to the application process, and which allows incorporating during said feeding a new reel in the other support of the reel holder and preparing the end of the laminar strip of this new reel on the splicer head, leaving this splicer head in standby for the automatic splicing of the laminar strip of the new reel with the laminar strip of the feed reel when this feed reel runs out, the splicing of the two laminar strips being performed with zero relative movement between them, but with a joint movement of both laminar strips at a certain speed (about 200 meters per minute) during splicing, as a result of projecting the splicer head, which moves at a speed slightly greater than that of the laminar strips, for the splicing operation.

Hence, the feed reel that is running out only has to be slowed down to the speed of the joint movement of the two laminar strips to be spliced, and therefore the necessary speeding up of the new reel to the speed of supply to the application process is also less, whereby speeds of constant feed supply that are greater than with conventional splicers can be established, without increasing the order of the stresses of the laminar strip that is being supplied and without having to oversize the variable-path storage.

Based on the foregoing, said proposed splicer has very advantageous features for its intended function, acquiring its own identity and preferred character with respect to known splicers having the same function.

DETAILED DESCRIPTION OF THE INVENTION

Figure 1:
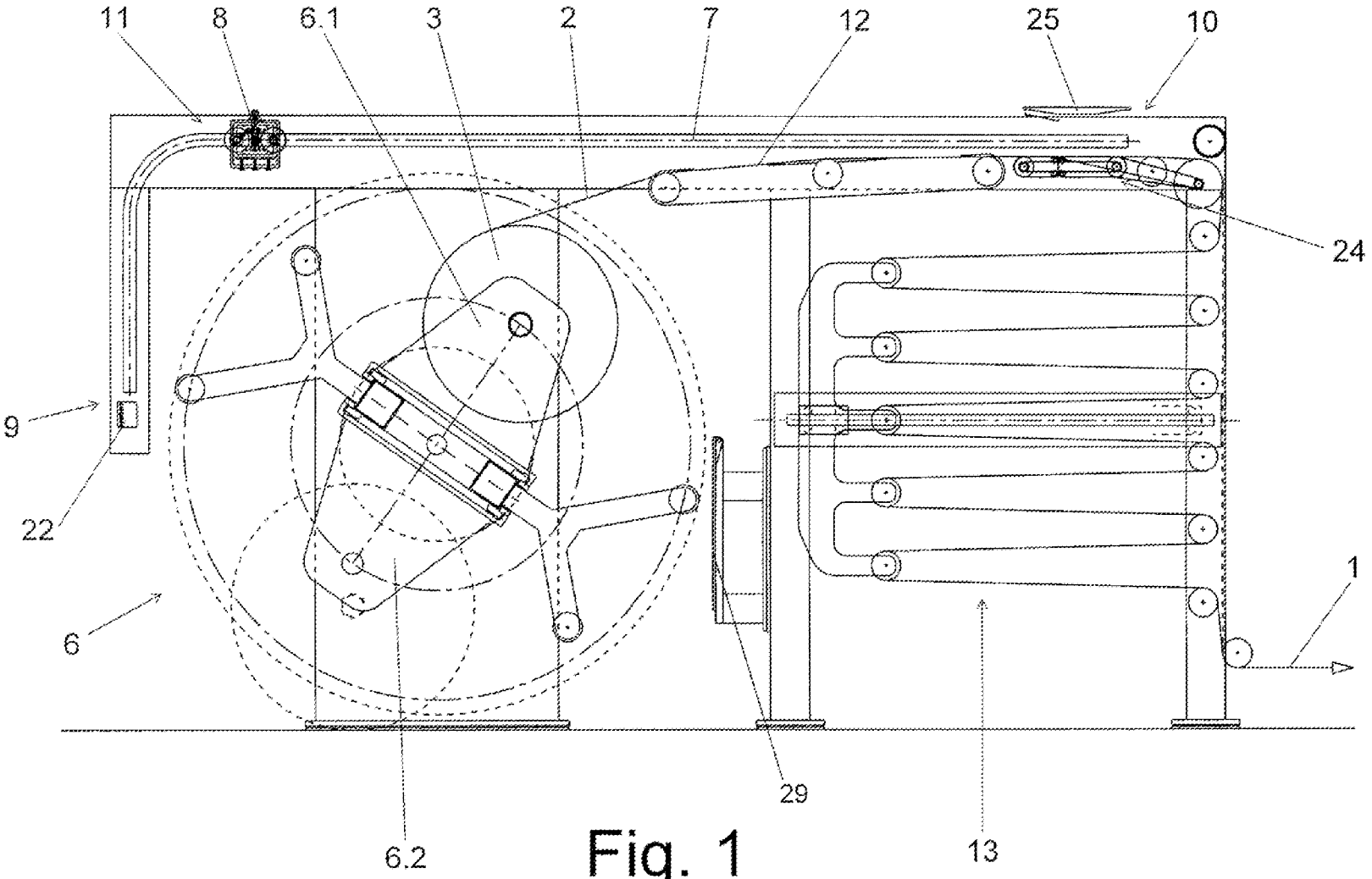
FIG. 1 shows a schematic side elevational view of a splicer according to the object of the invention.

The object of the invention relates to an automatic splicer intended for supplying in continuous feed a laminar strip (1) to an application process, based on splicing the laminar strip (2) from a feed reel (3) when the feed reel runs out with the laminar strip (4) of a new reel (5) arranged in standby to continue, the feeding, keeping the feeding to the application process constant during splicing.

The proposed splicer has a reel holder (6) having two supports (6.1 and 6.2) intended for incorporating respective reels (3 and 5) which can be alternated by means of rotating the reel holder (6) between the feed supply position for the application process, the loading position to load a new reel and the standby position to continue the feeding when the feed reel runs out.

There is arranged above the reel holder (6) a guide rail (7) on which a splicer head (8) is incorporated in sliding assembly, said guide rail (7) extending from a preparation zone (9) for preparing the laminar strip (4) of a new reel (5) on the splicer head (8) to a splicing zone (10) for splicing said laminar strip (4) of the new reel (5) with the laminar strip (2) of the feed reel (3); the splicer head (8) can move between said zones (9 and 10), passing through a standby zone (11) from which said splicer head (8) can move in projected movement to the splicing zone (10).

The laminar strip (2) leaving the feed reel (3) passes through a pivoted support (12) leading it to the splicing zone (10), after which said laminar strip (2) is the laminar strip (1) intended for being supplied to the application process, passing through a variable-path storage (13) which allows maintaining a continuous feeding of said laminar strip (1) to the application process during the operation of splicing the laminar strip (4) of the new reel (5) intended for continuing the feeding with the laminar strip (2) of the feed reel (3) when the feed reel runs out.

Figure 2A:
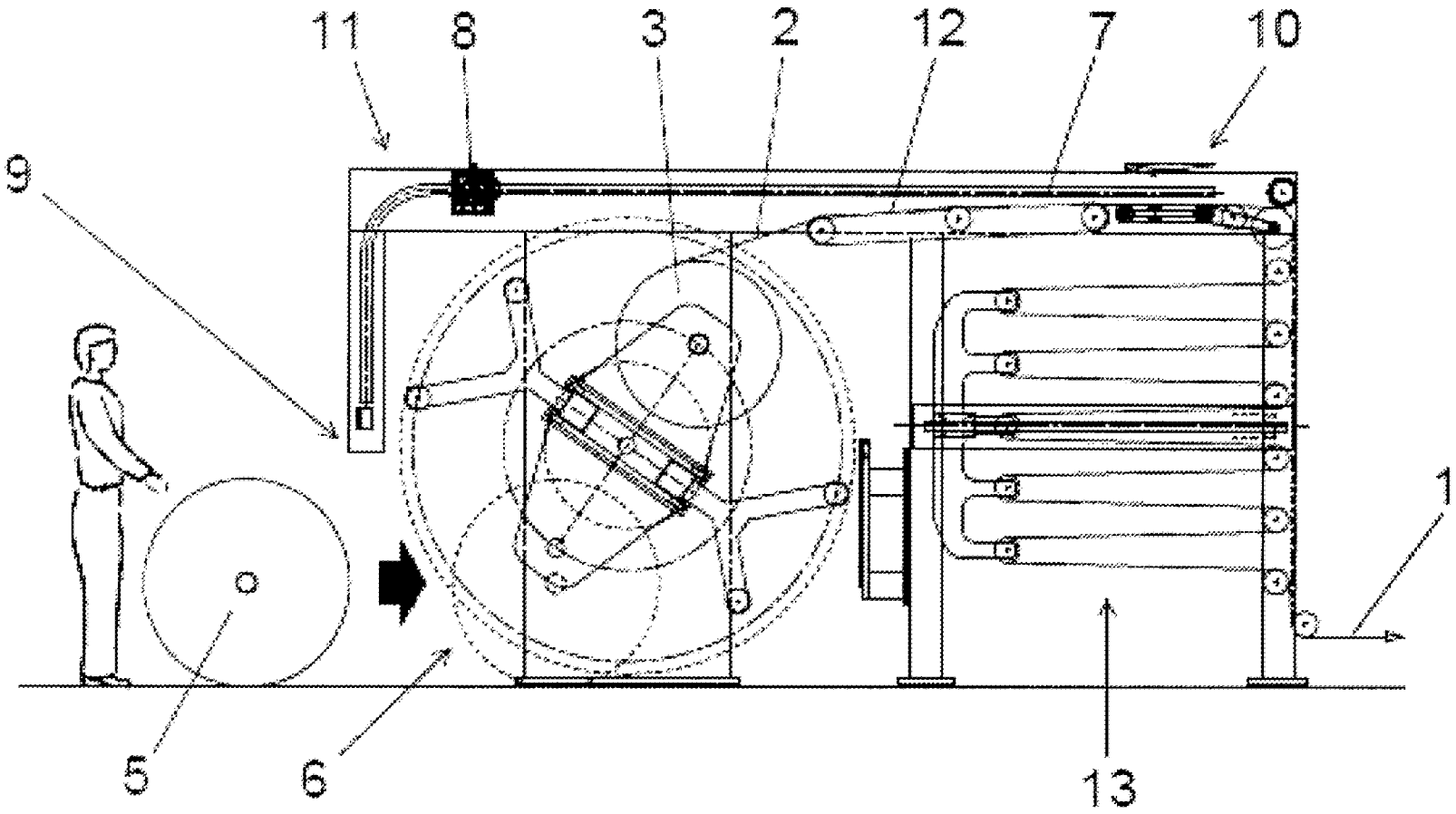
FIGS. 2A to 2J show successive positions of said splicer object of the invention in the process from the preparation of a reel new in standby to the splicing of the laminar strip of said reel new with the laminar strip of the feed reel when the latter runs out.
Figure 2B:
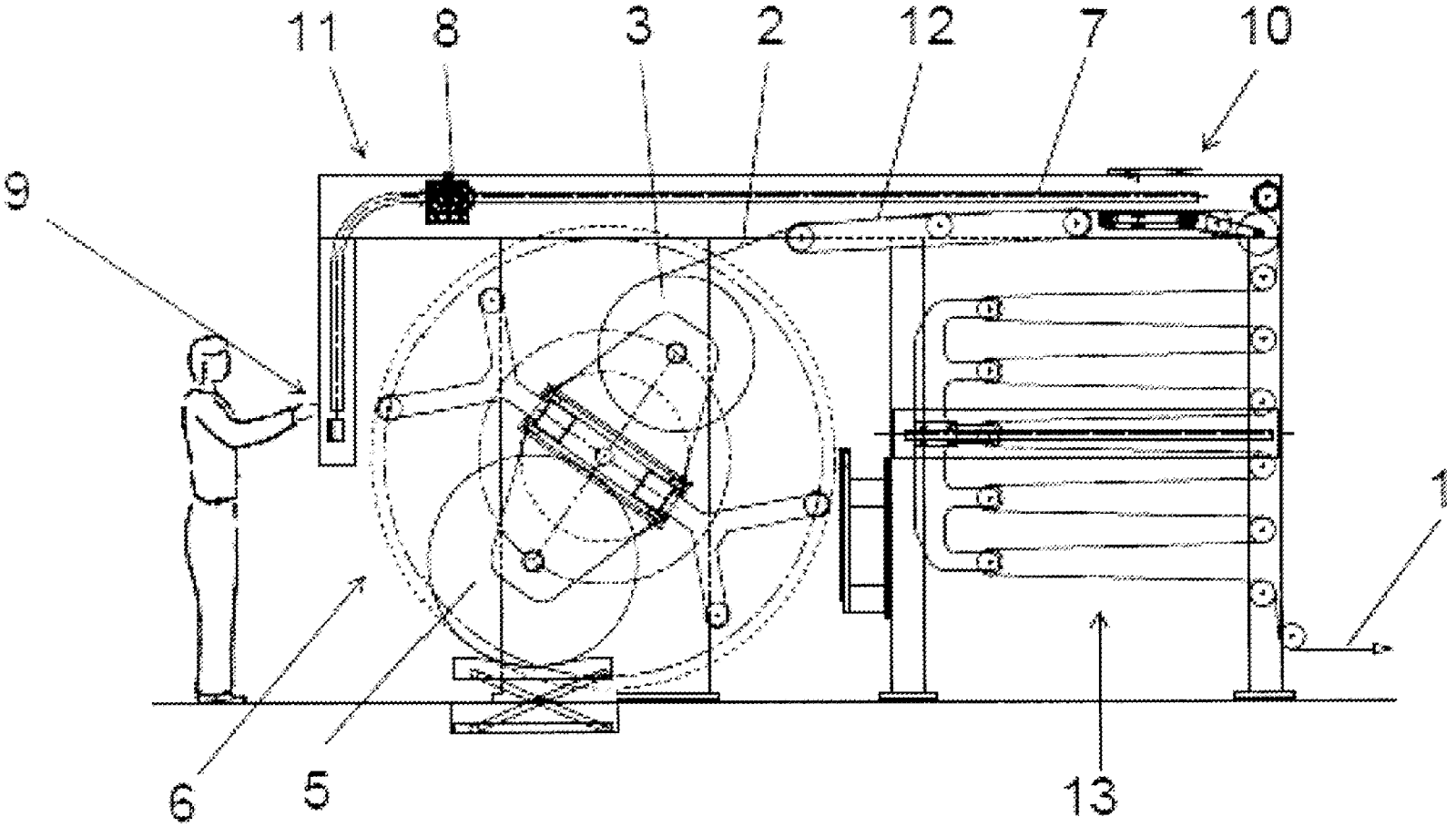

Therefore, starting from a normal situation of feeding the laminar strip (1) to the application process from a feed reel (3) arranged in the support (6.1) of the reel holder (6), for example, during the feeding process itself, a new reel (5) can be introduced and incorporated in the support (6.2) of the reel holder (6), as shown in FIGS. 2A and 2B.

Figure 2C:
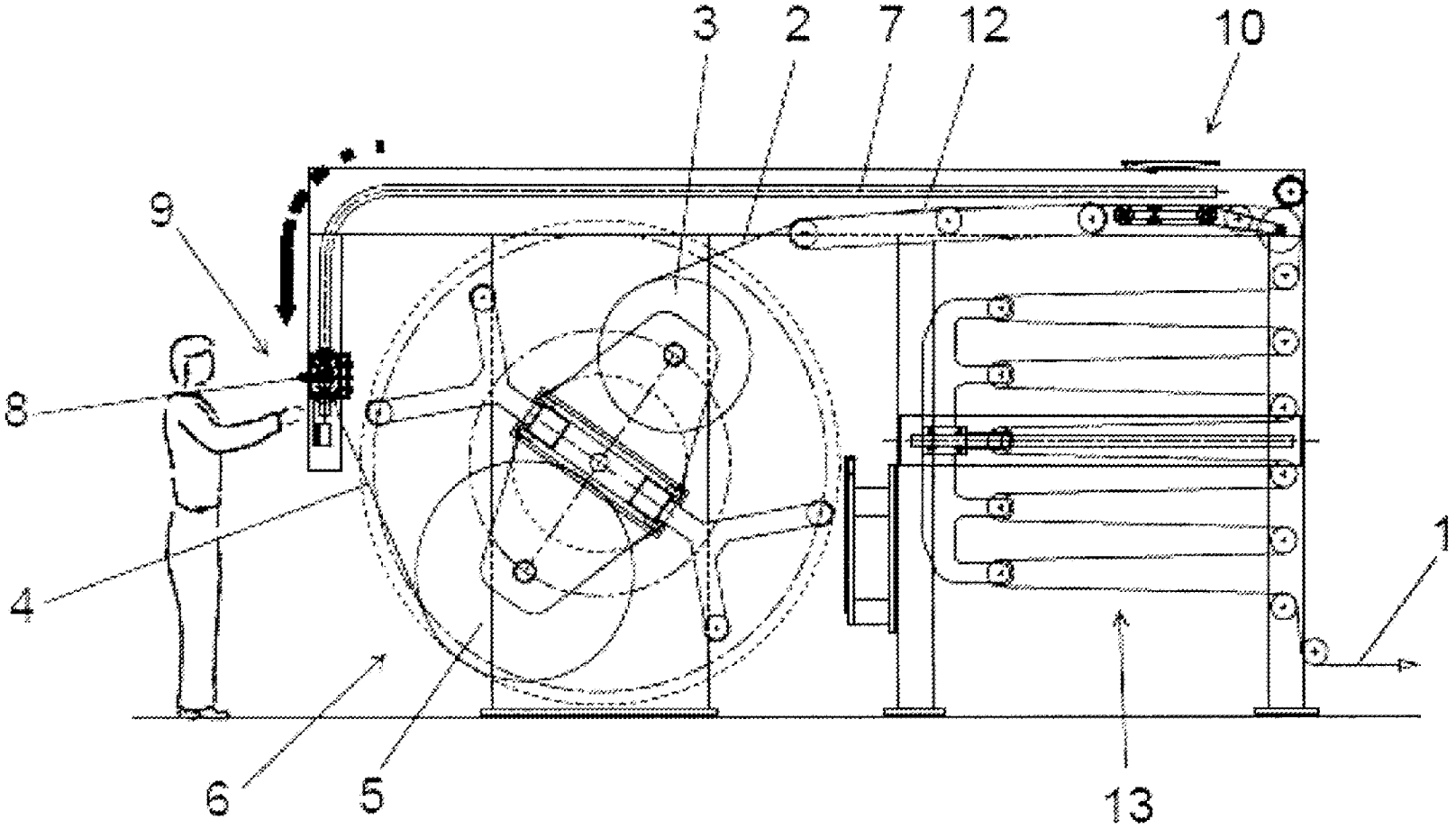
Figure 2D:
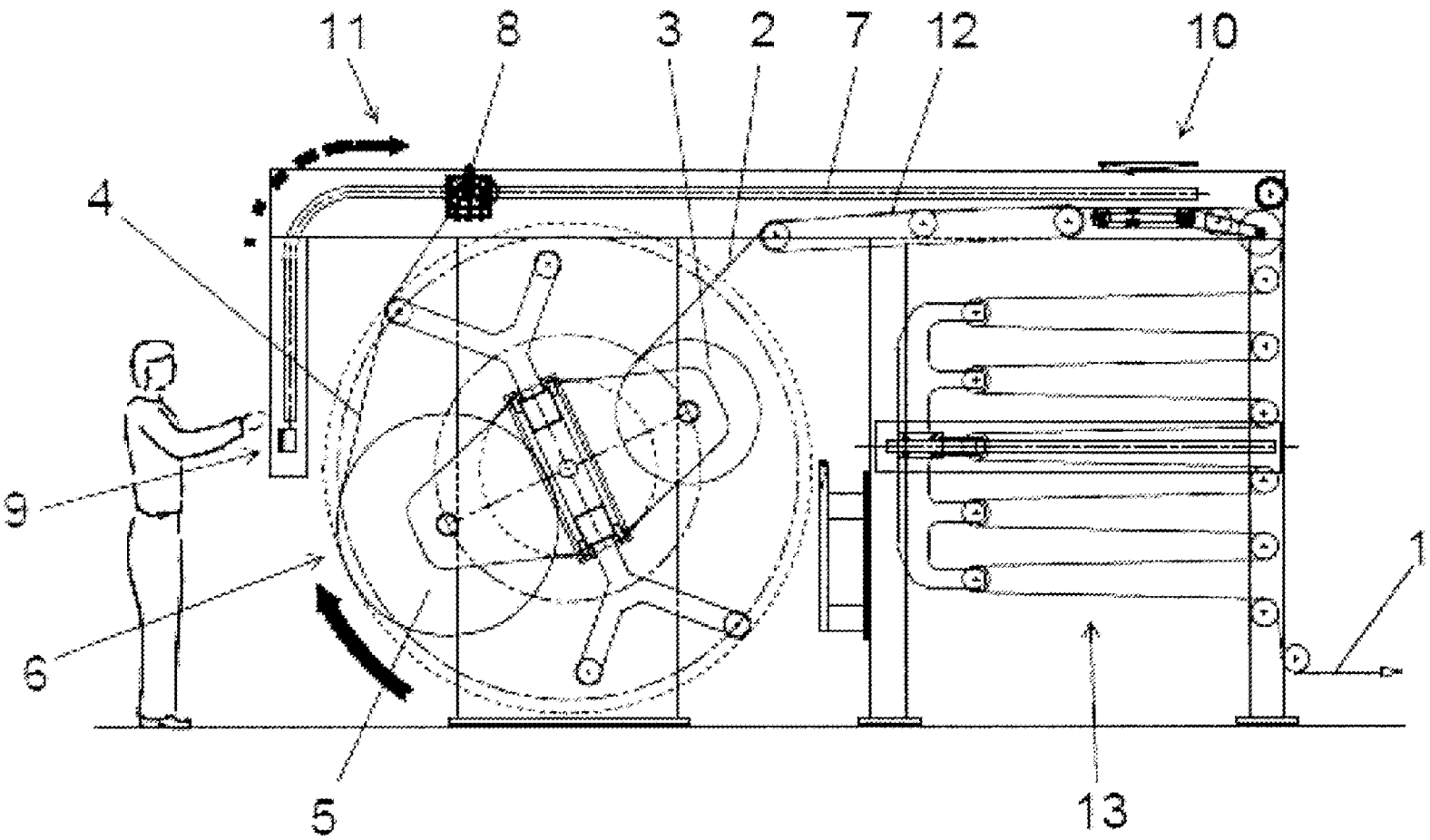

Once the new reel (5) is incorporated in the reel holder (6), the preparation of the end of the laminar strip (4) of the new reel (5) on said splicer head (8) is performed by means of moving the splicer head (8) to the preparation zone (9) as shown in FIG. 2C, after which the splicer head (8) moves to the standby zone (11), rotating the reel holder (6) to a position that favors that positioning of the splicer head (8) with the end of the laminar strip (4) secured thereon, as seen in FIG. 2D.

Figure 2E:
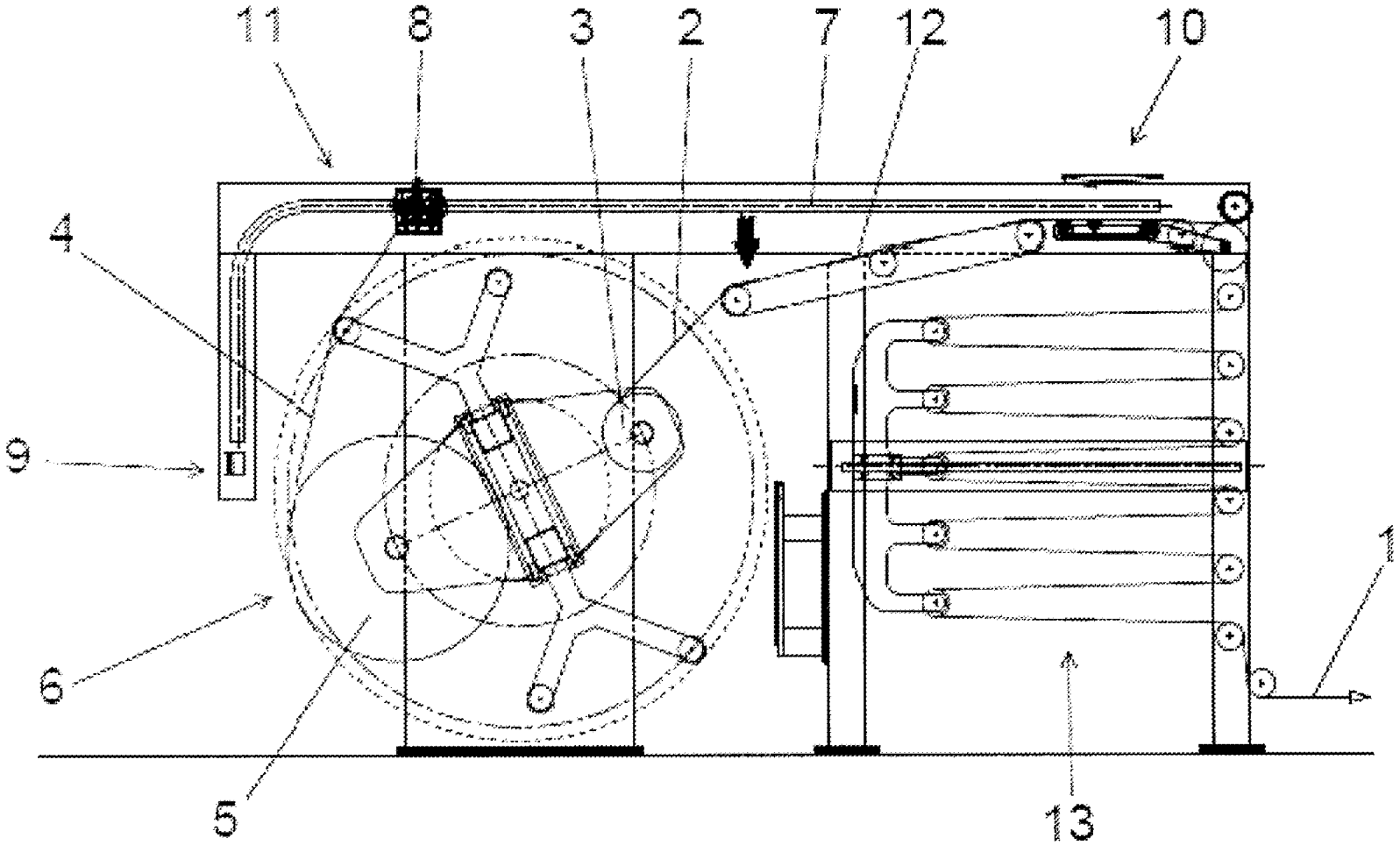
Figure 2F:
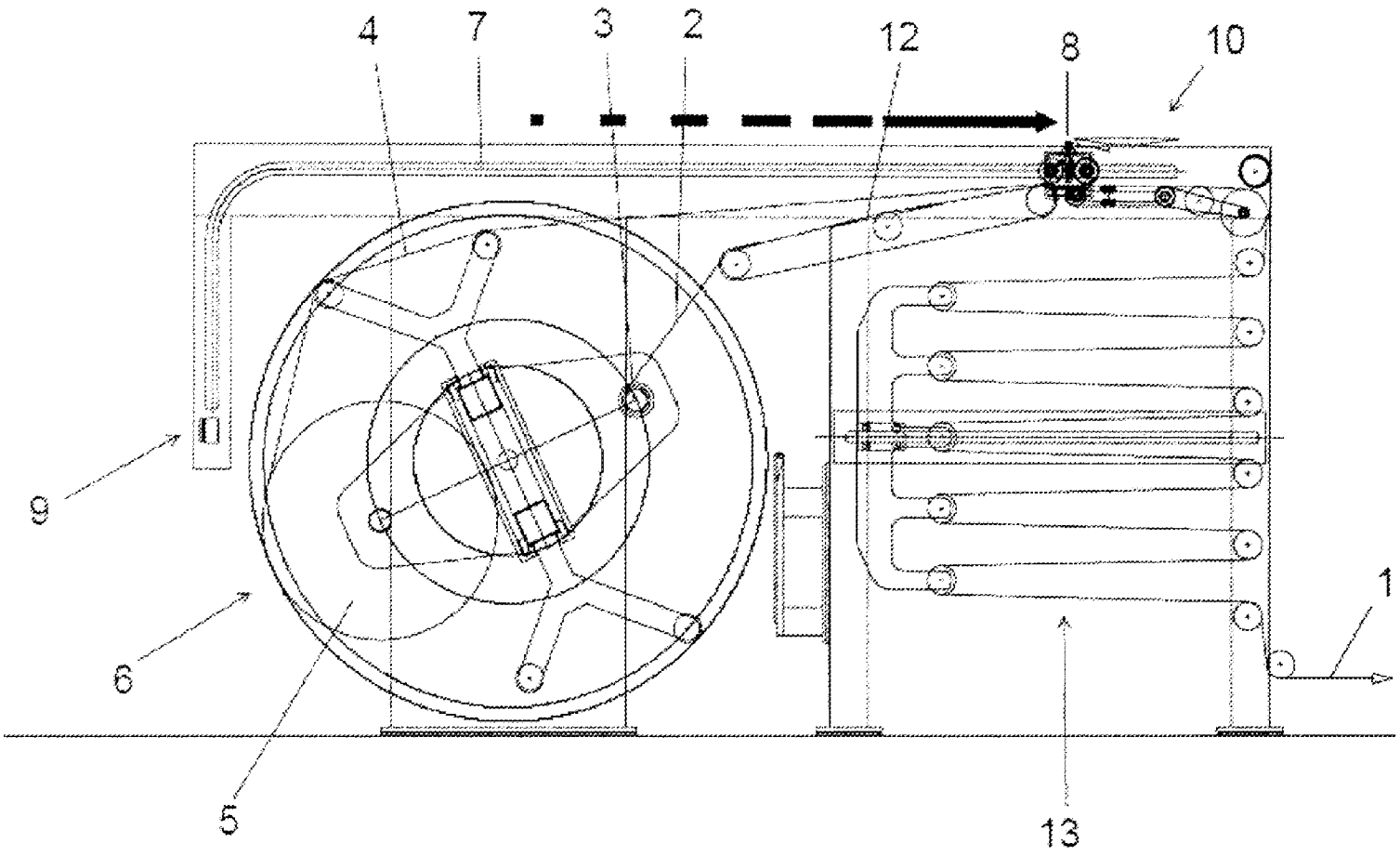

That arrangement is maintained until the feed reel (3) almost runs out, such that when that circumstance is detected the support (12) pivots downwards, as seen in FIG. 2E, and when it reaches the end of said feed reel (3), the feed reel slows down, the variable-path storage (13) starting to become narrower to keep the feeding of the laminar strip (1) to the application process constant. At this moment the splicer head (8) is projected towards the splicing zone (10), as seen in FIG. 2F.

Figure 2G:
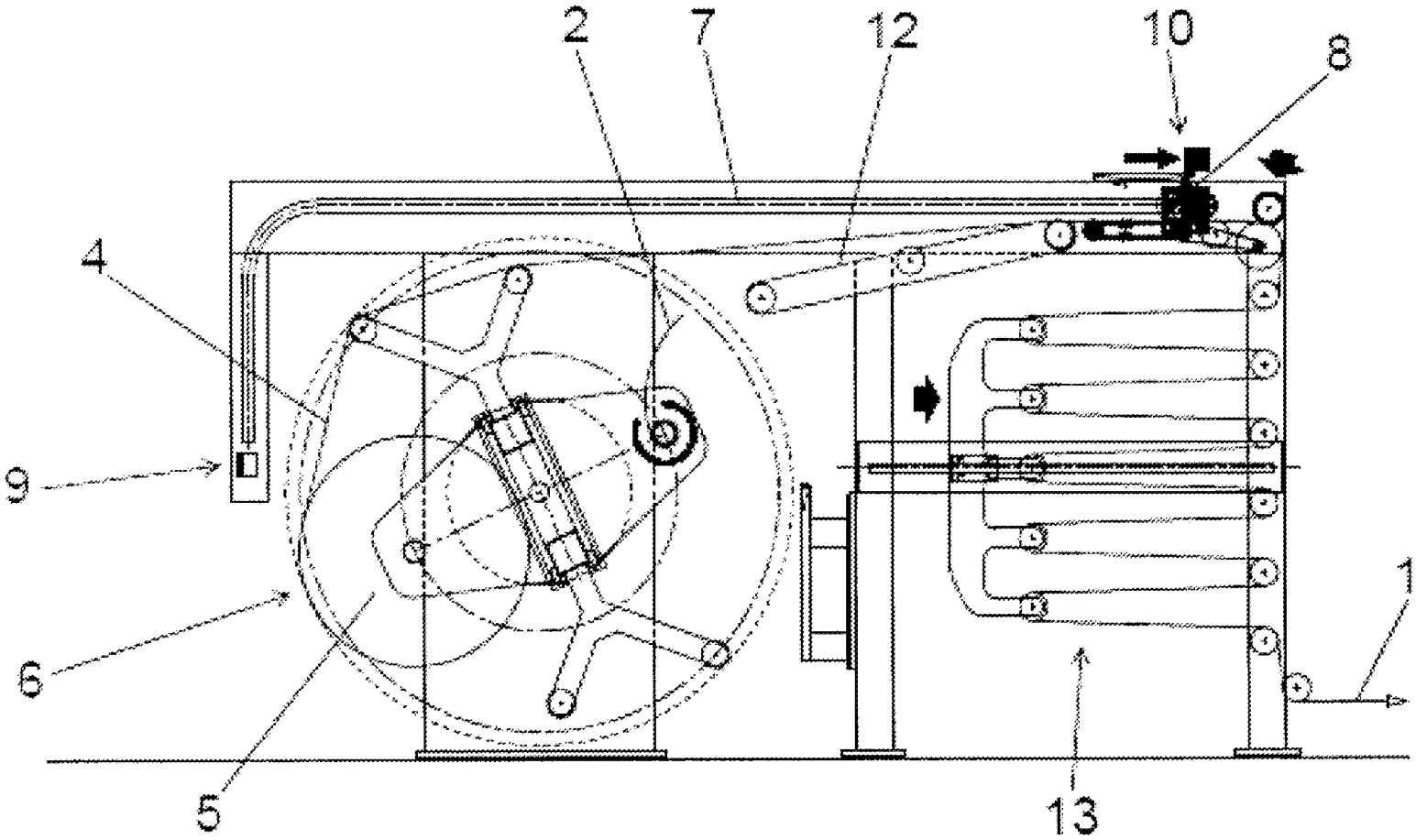

When the splicer head (8) reaches the splicing zone (10), the speed thereof is slightly greater than the speed of the laminar strip (2) after the slowing down of the feed reel (3). Therefore, when a roller (19) of the splicer head (8) contacts the laminar strip (2) on the support (24), said roller (18) and another roller (19) of the splicer head (8) can move by rotating over the laminar strip (2), the splicing of the laminar strip (4) on the splicer head (8) and the laminar strip (2) from the feed reel (3) thus occurs under conditions of joint movement of both laminar strips (2 and 4) but without relative movement between them, while at the same time the variable-path storage (13) continues to narrow, as seen in FIG. 2G, whereby the splicing of the laminar strips (2 and 4) occurs without having to stop the laminar strip (2) from the feed reel (3), so only partial slowing down of the feed reel (3) is required.

Figure 2H:
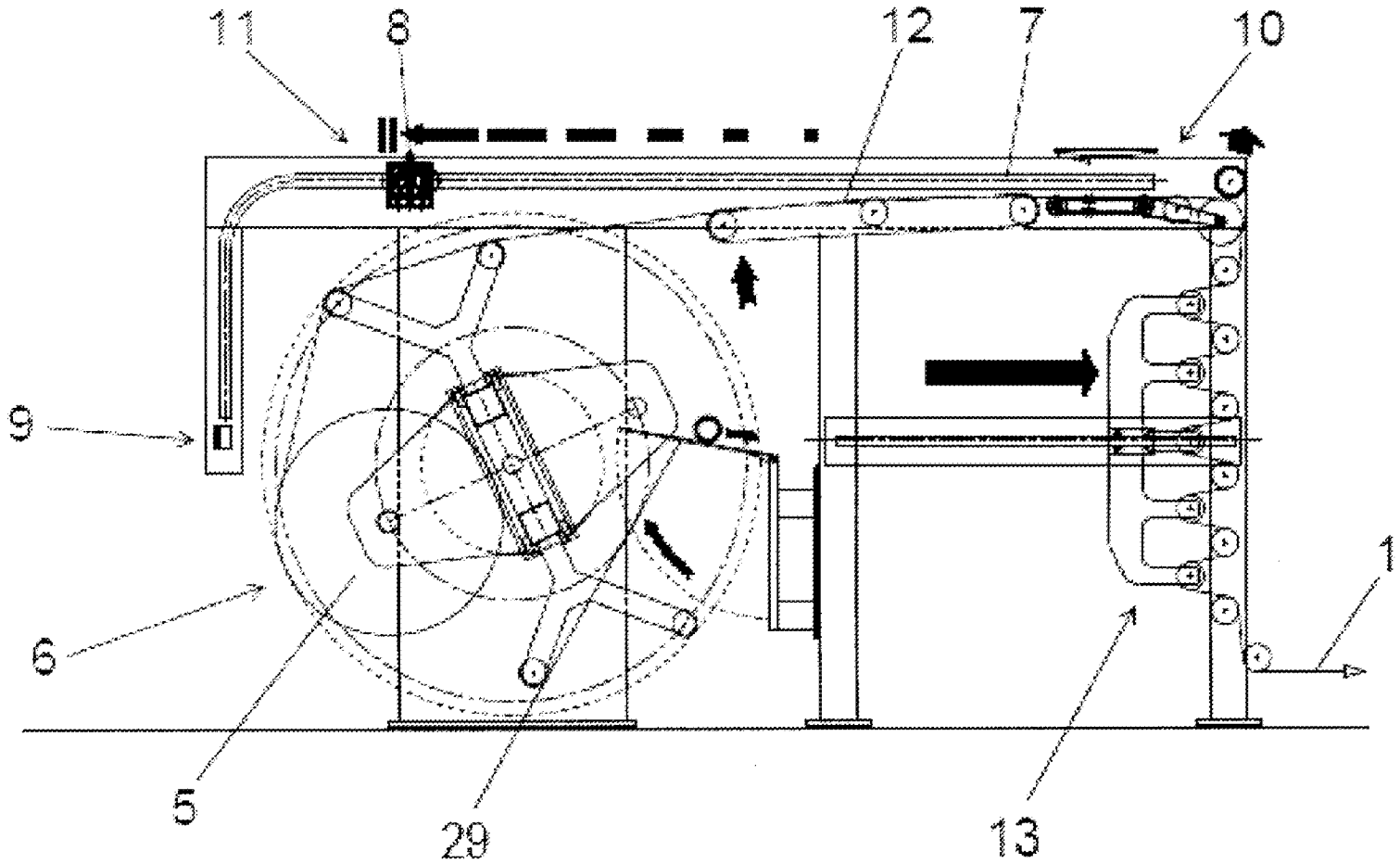
Figure 2I:
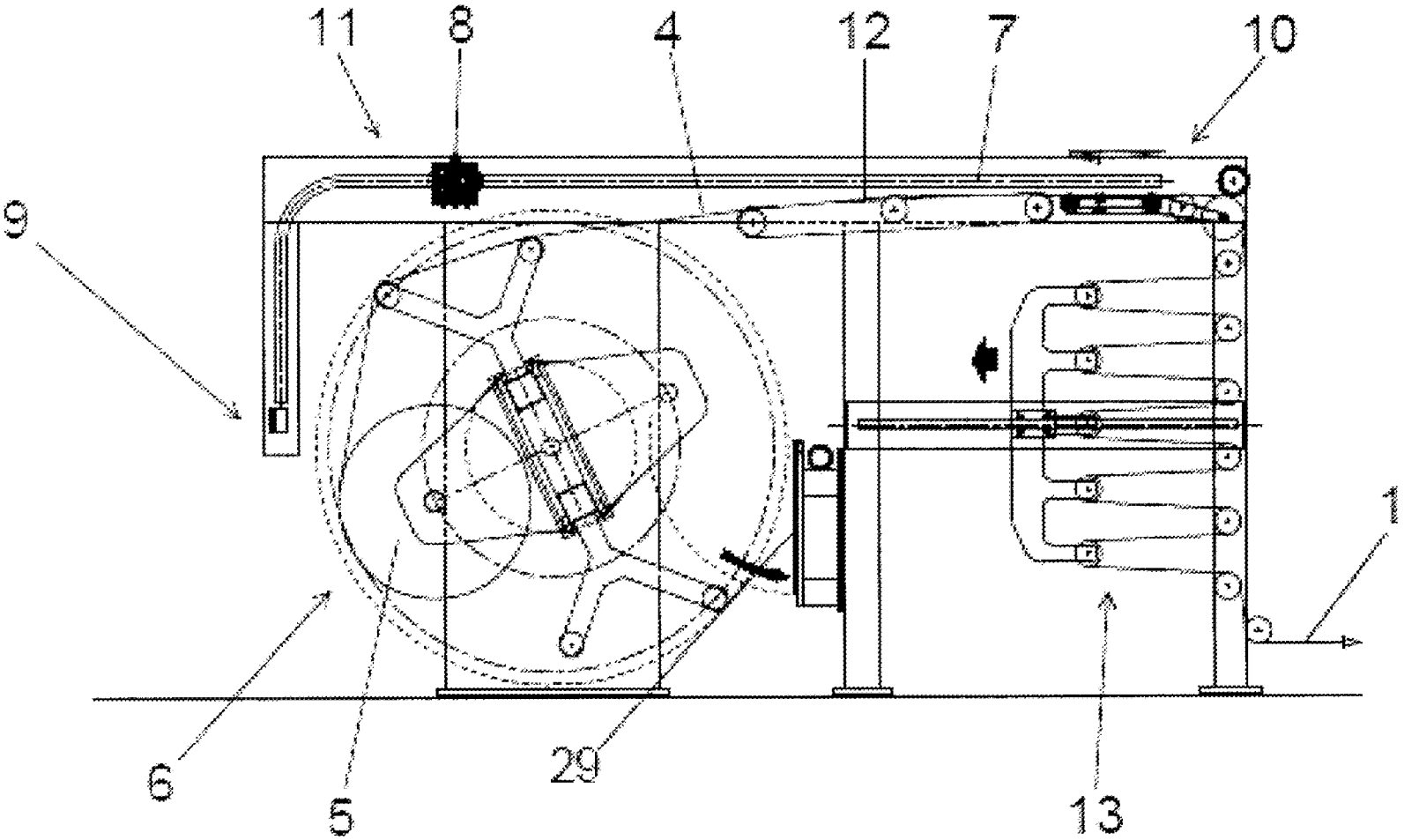
Figure 2J:
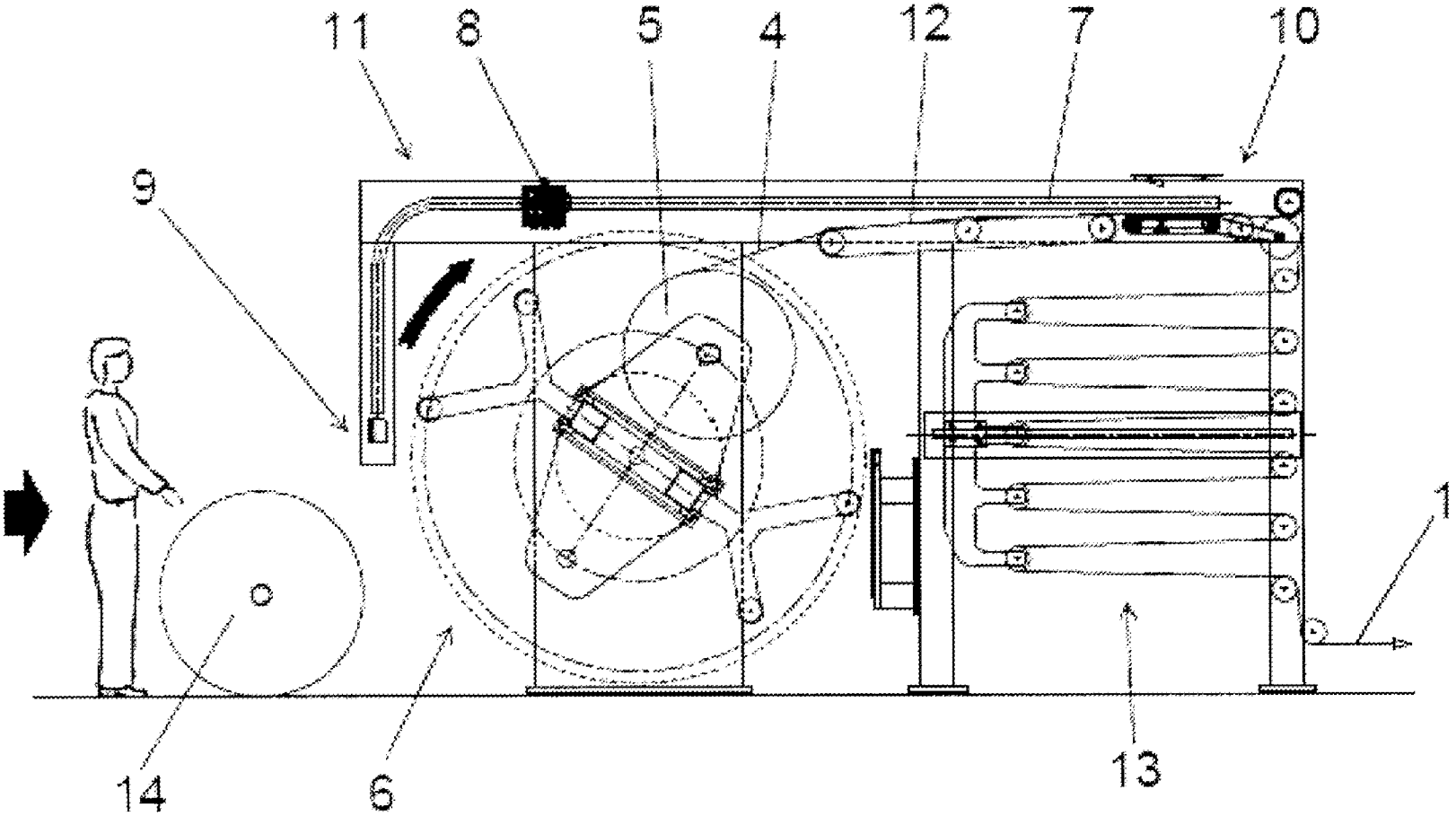
Figure 3:
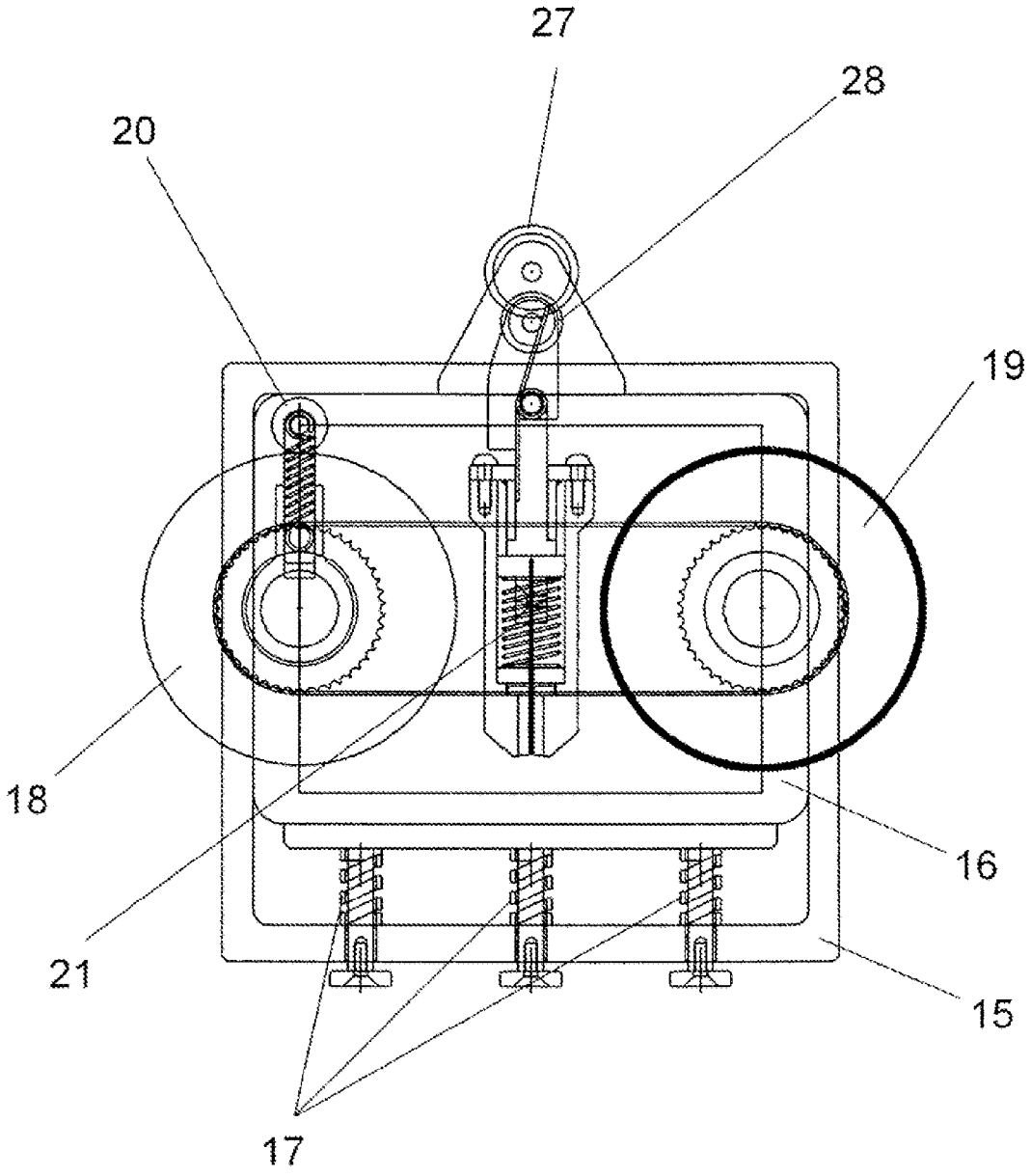
FIG. 3 shows a schematic view of the formation of the splicer head joining the laminar strips of the reel new and of the feed reel.

Once splicing is performed, the splicer head (8) can return to the standby zone (11) and the support (12) pivots upwards to the normal position, the new reel (5) starting to speed up, and during these operations the narrowing of the variable-path storage (13) continues for maintaining the operating speed for feeding the laminar strip (1) to the application process, as seen in FIG. 2H. At this moment, the remainder of the reel (3) can be unloaded by means of a system of a pivoting ramp (29), as seen in FIG. 2H. The ramp (29) must pivot again to allow rotating the reel holder (6) as seen in FIG. 2I.

The variable-path storage (13) continues to narrow until the moment in which the new reel (5) acquires the speed for the feeding of the laminar strip (1), in which moment the variable-path storage (13) ceases its movement. Starting from this moment, whenever appropriate, the new reel (5) can be sped up above the speed for the feeding of the laminar strip (1) to allow widening the variable-path storage (13), as can be seen in FIG. 2I.

The splicer head (8) has a body (15) established in sliding assembly on the guide rail (7), there being incorporated on said body (15) a carriage (16) arranged in vertical movement assembly supported on springs (17), in which parallel rollers (18 and 19) which rotate in synchronized movement are incorporated, the first roller (18) being provided with a clamping device (20), whereas a cutting mechanism (21) which is in turn incorporated in vertical elastic movement assembly is arranged between the two rollers (18 and 19).

Figure 4A:
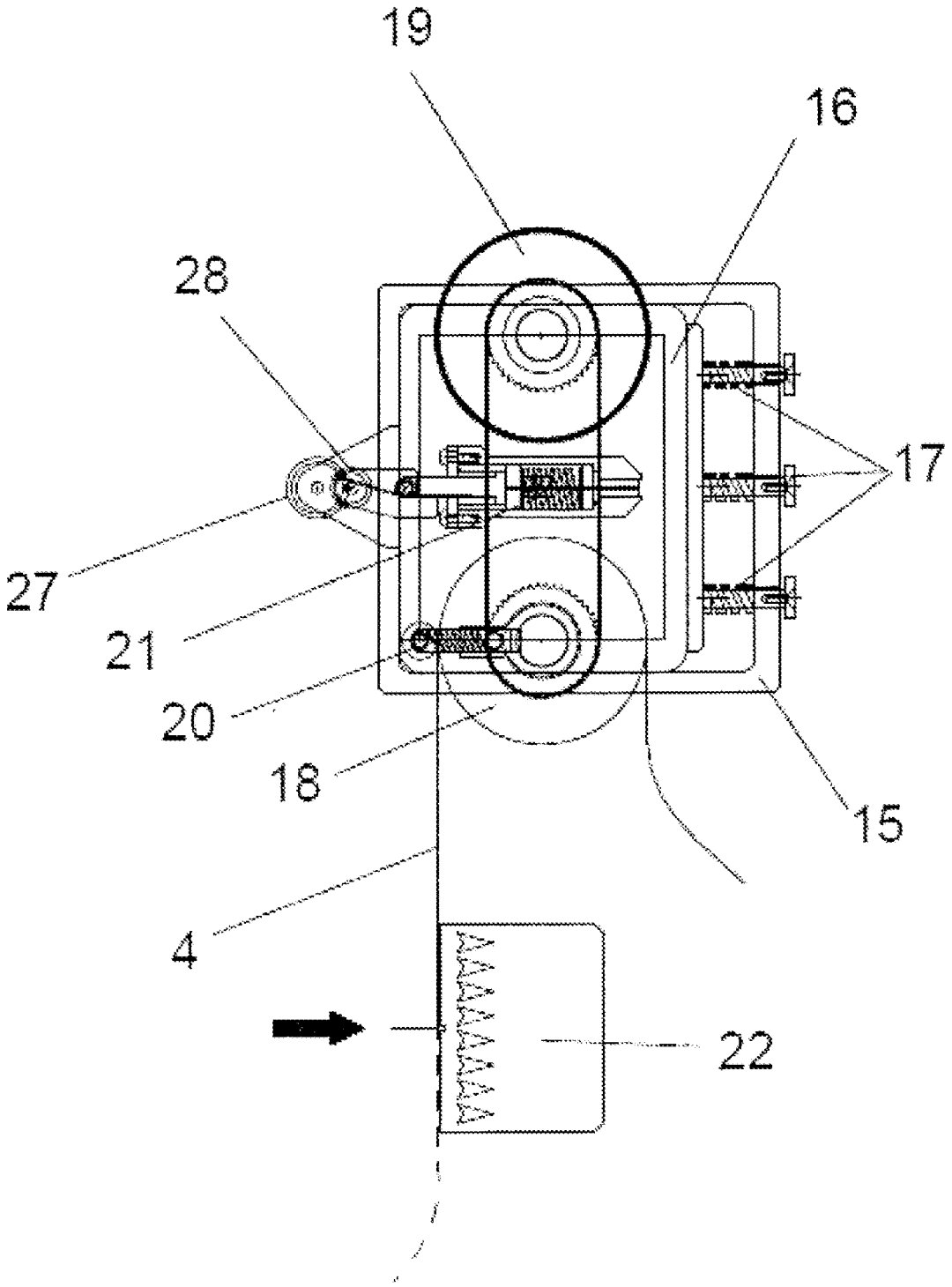
FIGS. 4A to 4F show in enlarged detail the sequence of preparation of the laminar strip of a new reel on the splicer head.

For the preparation of the laminar strip (4) of a new reel (5) on the splicer head (8), a vacuum chamber (22) is arranged in the preparation zone (9), the preparation of the laminar strip (4) on the splicer head (8) being performed in the following manner:

First, the laminar strip (4) from the new reel (5) is passed over the first roller (18) of the splicer head (8), carrying it to the vacuum chamber (22), on which said laminar strip (4) is secured by the action of vacuum for cutting the end thereof such that the end edge is perfectly straight and perpendicular to the sides, as seen in FIG. 4A.

Figure 4B:
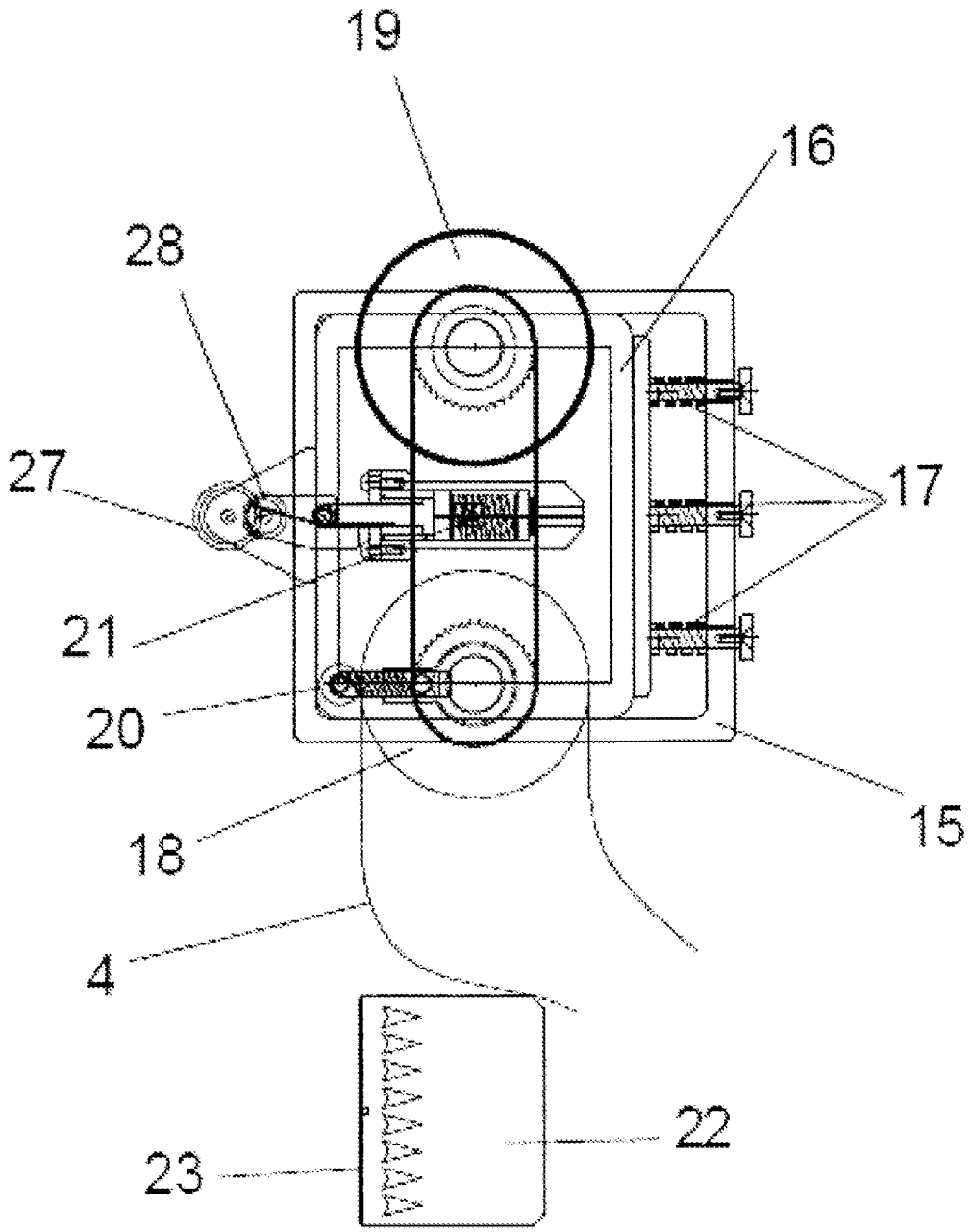
Figure 4C:
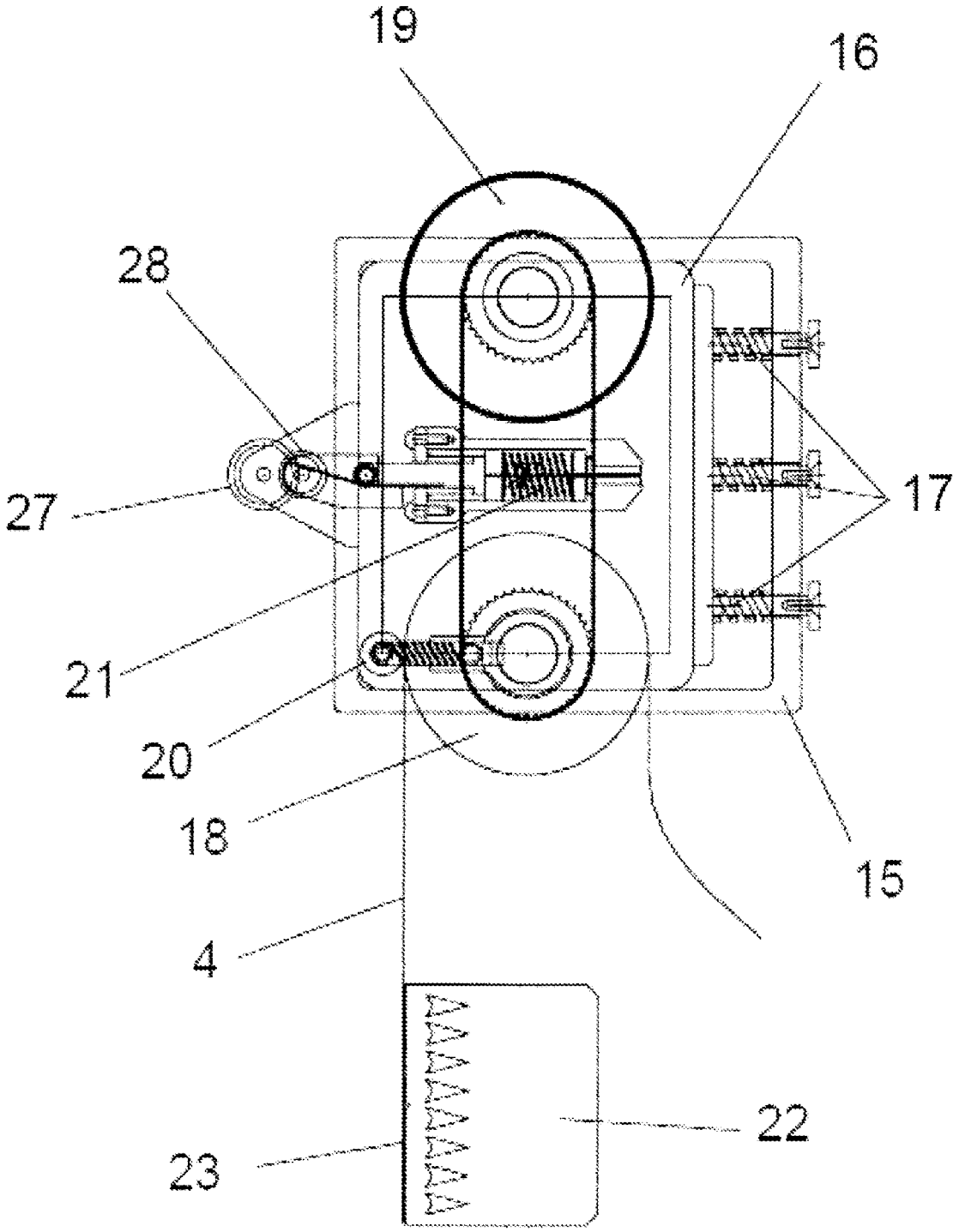

Next, vacuum application is stopped to enable removing the laminar strip (4) from the securing on the vacuum chamber (22). Subsequently, vacuum is again applied in the vacuum chamber (22) and an adhesive strip (23) is arranged on said vacuum chamber (22), as shown in FIG. 4B, and the end of the laminar strip (4) is then fixed on half the width of said adhesive strip (23), as seen in FIG. 4C.

Figure 4D:
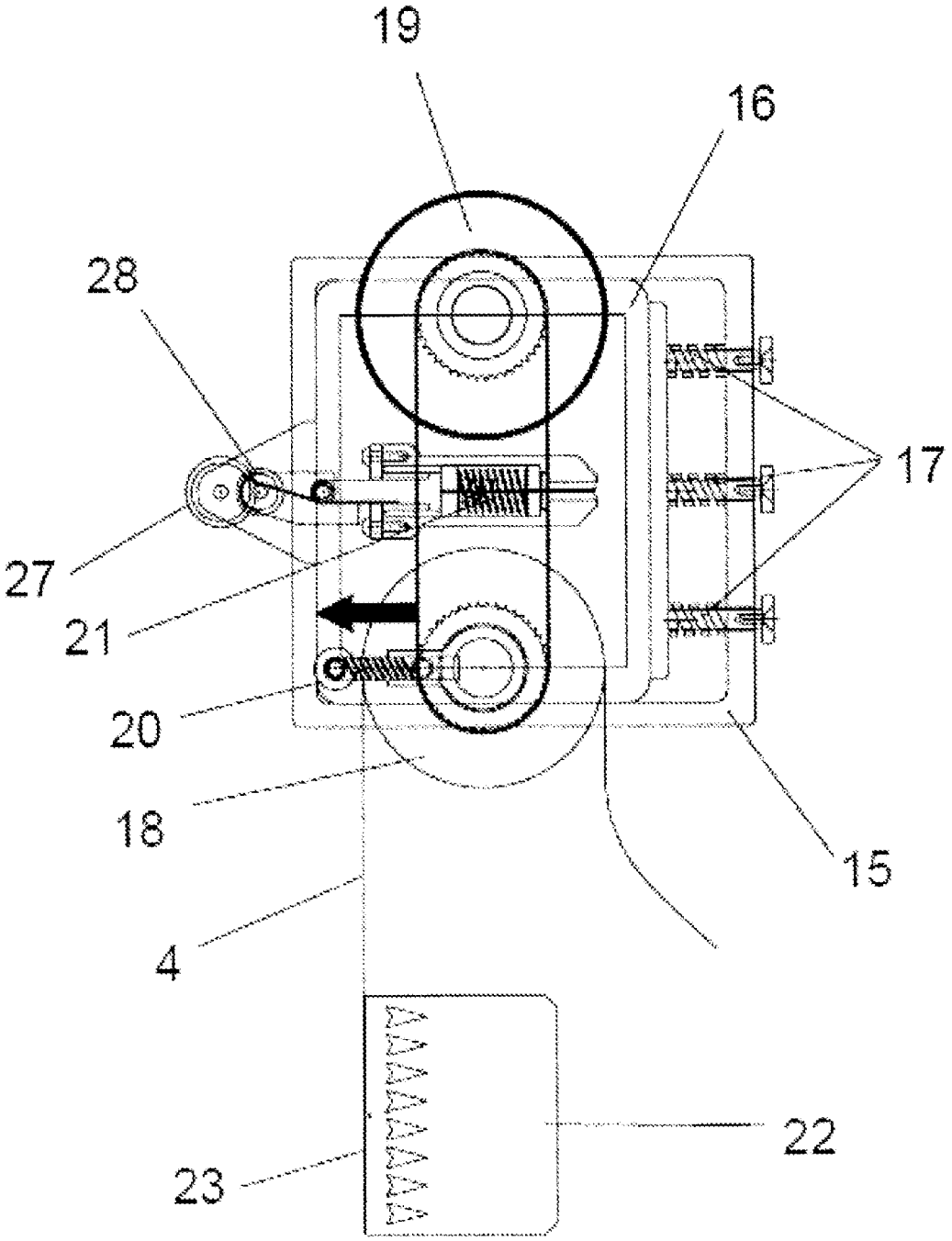
Figure 4E:
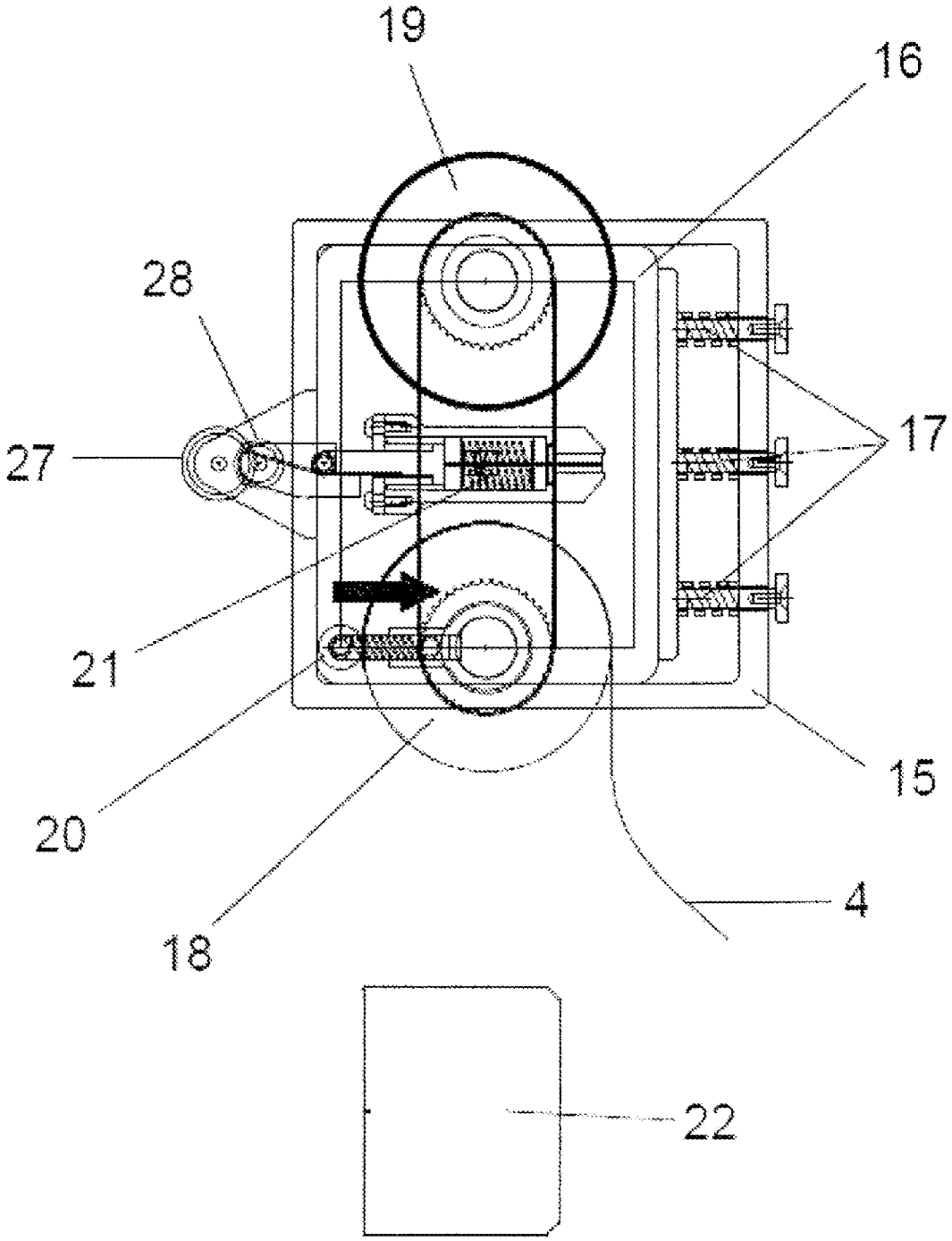

Then the clamping device (20) of the roller (18) of the splicer head (8) is loosened, as shown in FIG. 4D, the vacuum of the vacuum chamber (22) then being eliminated, such that the adhesive strip (23) fixed on the laminar strip (4) is not secured, which allows carrying the end of said laminar strip (4) with the adhesive strip (23) fixed thereon to a specific position on the roller (18), in which said end of the laminar strip (4) provided with the adhesive strip (23) is secured with the clamping device (20), as seen in FIG. 4E.

Figure 4F:
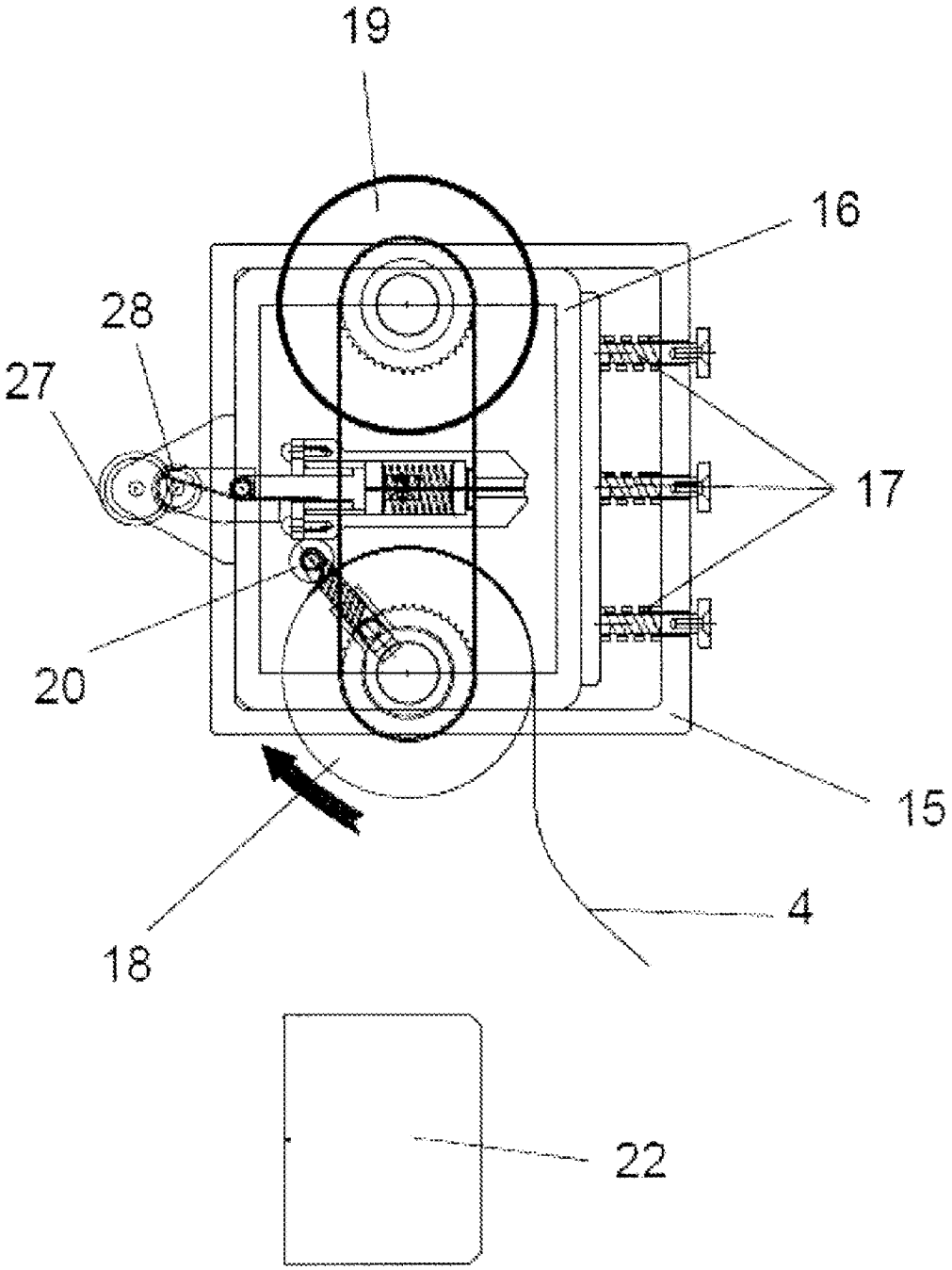

Once in this position, the roller (18) is rotated, as seen in FIG. 4F, to a position in which the end of the laminar strip (4) is precisely located for splicing said laminar strip (4) with the laminar strip (2) of the feed reel (3).

Splicing of the laminar strip (4) of the new reel (5) with the laminar strip (2) from the feed reel (3) is performed automatically by a functional action of the splicer head (8) in the travel through the splicing zone (10), where the laminar strip (2) for feeding passes over a support (24) formed by two consecutive continuous bands arranged below the guide rail (7), whereas above said guide rail (7) there are ramps (25 and 26) coming into contact, respectively, with respective stops (27 and 28) which the carriage (16) and the cutting mechanism (21) of the splicer head (8) have in the upper portion.

Figure 5A:
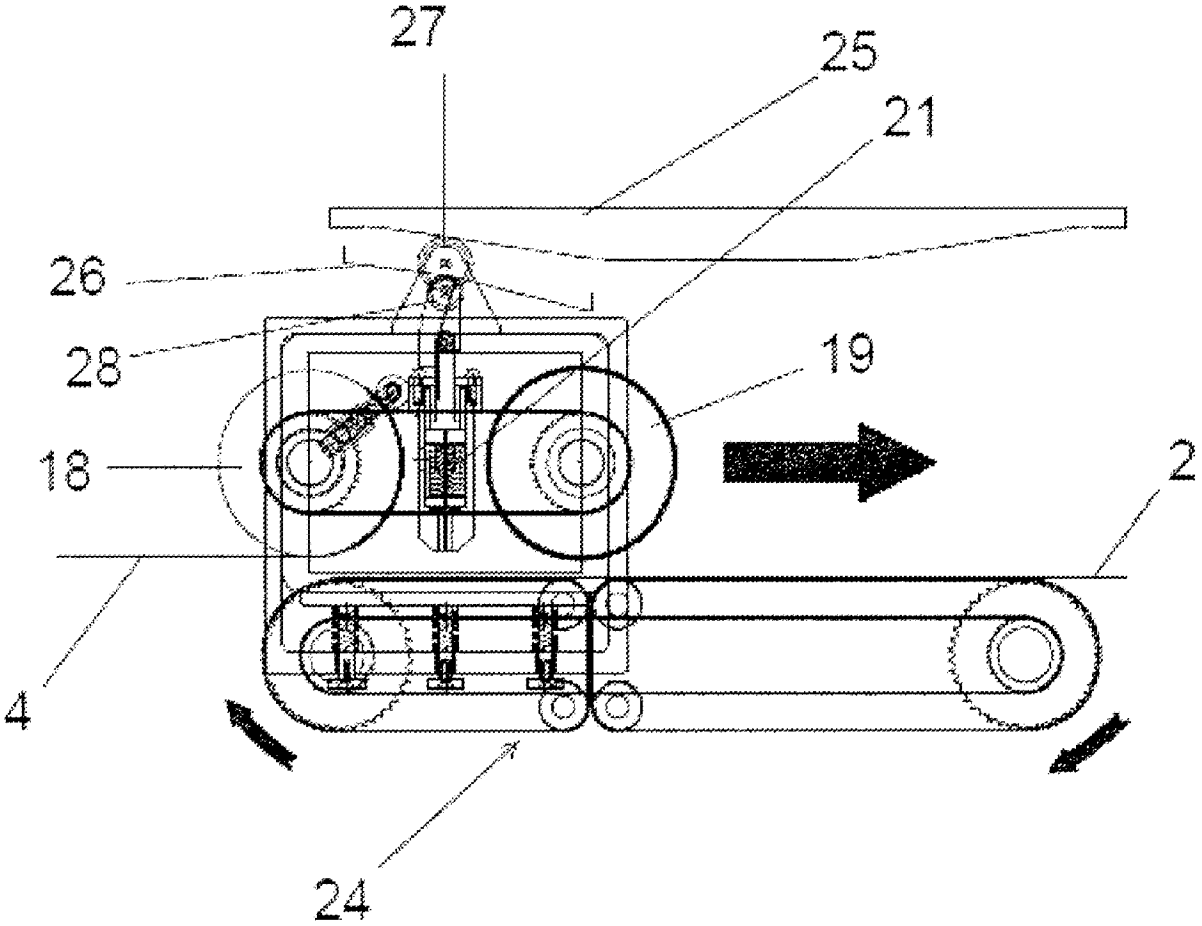
FIGS. 5A to 5H show in enlarged detail the sequence of the splicing of a new laminar strip prepared on the splicer head with the laminar strip of a feed reel that is running out.

Therefore, when the splicer head (8) in projected movement reaches the splicing zone (10), the end of the laminar strip (4) with the adhesive strip (23) fixed thereon being secured in the roller (18), in the entry to said splicing zone (10) the upper stop (27) of the carriage (16) contacts the ramp (25), whereas the upper stop (28) of the cutting mechanism (21) contacts the ramp (26), as seen in FIG. 5A.

Figure 5B:
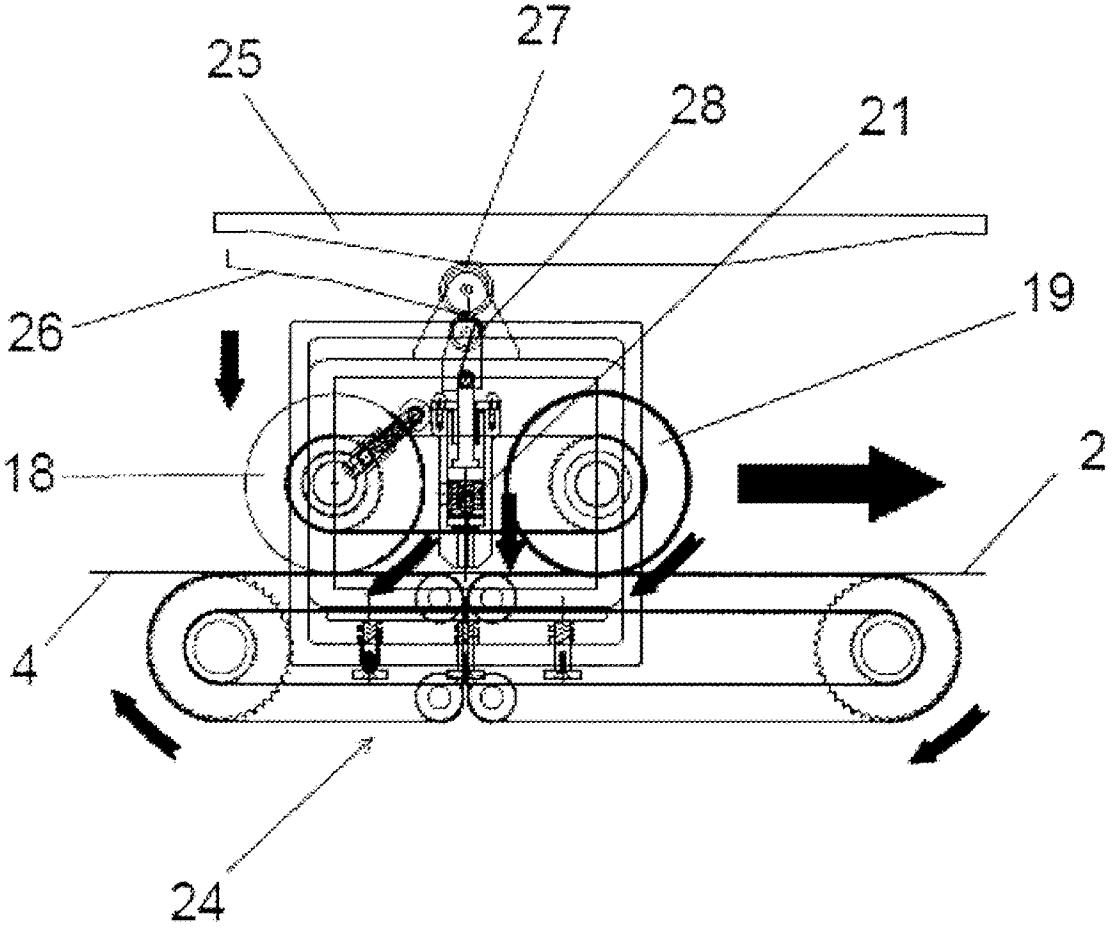

As the splicer head (8) continues to move forward, due to the contact of the stops (27 and 28) with the ramps (25 and 26) the carriage (16) and the cutting mechanism (21) move downwards, so the rollers (18 and 19) press the laminar strip (2) against the support (24). Since the speed of the splicer head (8) is slightly greater than the speed of the laminar strip (2), the rollers (18 and 19) can move by rotating over said laminar strip (2), and right in the passage between the continuous bands making up said support (24), the blade of the cutting mechanism (21) cuts the laminar strip (2), keeping the two resulting portions of said laminar strip (2) secured by the rollers (18 and 19) against the support (24), as seen in FIG. 5B.

Figure 5C:
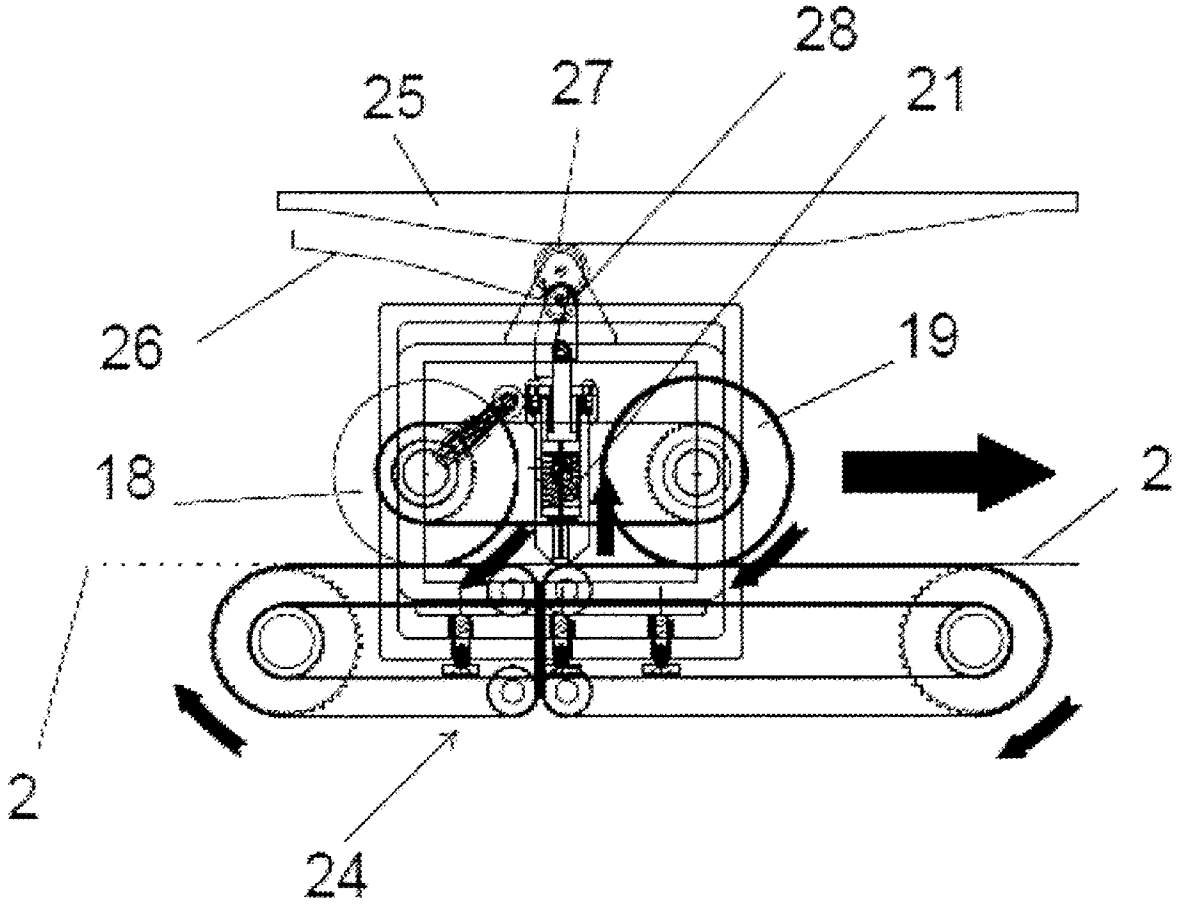
Figure 5D:
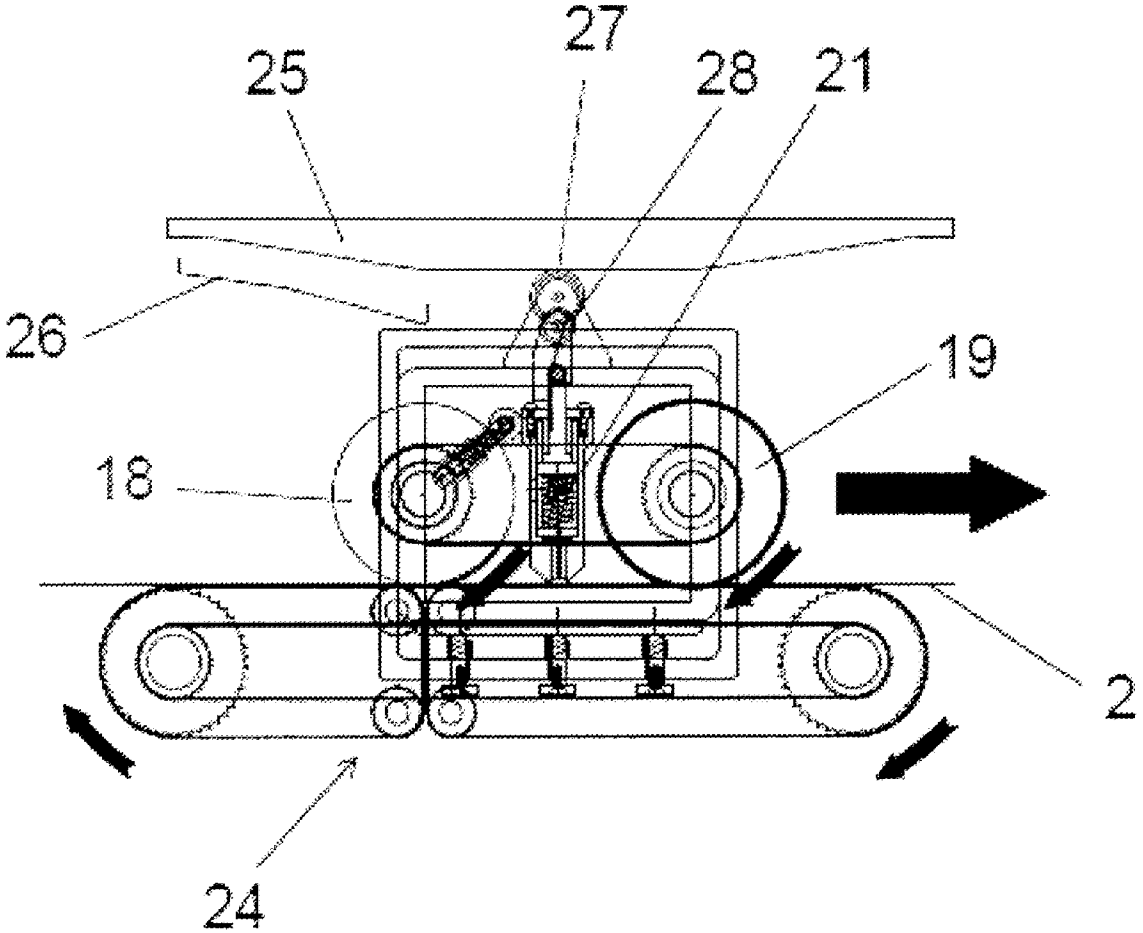

Once the cut is made, the cutting mechanism (21) moves up again since its upper stop (28) has risen above the ramp (26), no longer being supported thereon, whereas the rollers (18 and 19) continue to press on the portions resulting from cutting the laminar strip (2), as seen in FIG. 5C. From this moment, and due to the greater speed of movement of the splicer head (8), the roller (18) gradually leaves the end zone of the laminar strip (4) from the new reel (5) on said support (24), as shown in FIG. 5D.

Figure 5E:
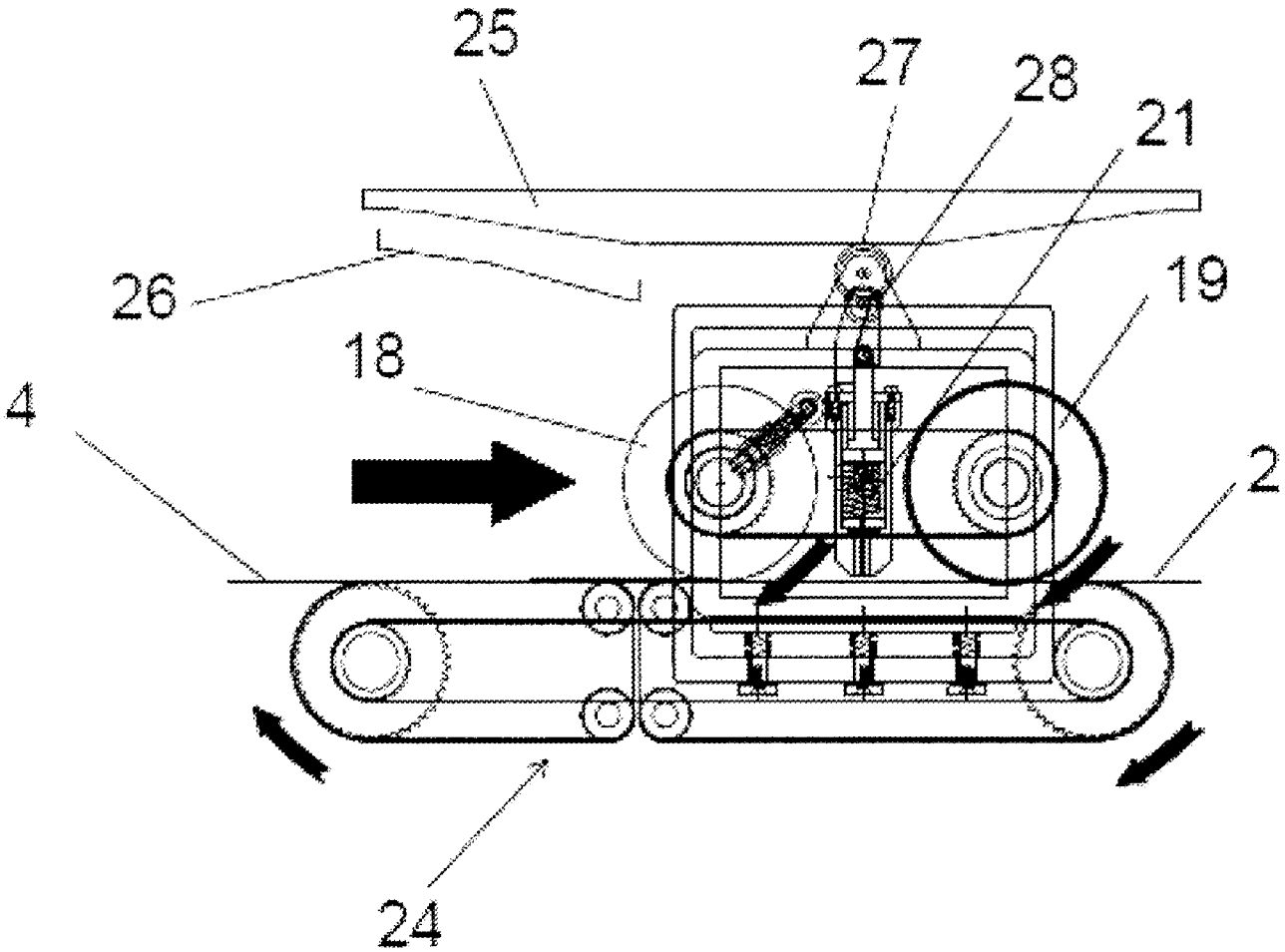

Under those conditions, the end edge of the laminar strip (4) from the new reel (5) is positioned facing the end edge of the laminar strip (2), the free half of the width of the adhesive strip (23) being fixed on this end of the laminar strip (2), whereby both laminar strips (2 and 4) are joined by splicing, the joint having been pressed by the passage of the roller (18) pressing thereon, as seen in FIG. 5E.

Figure 5F:
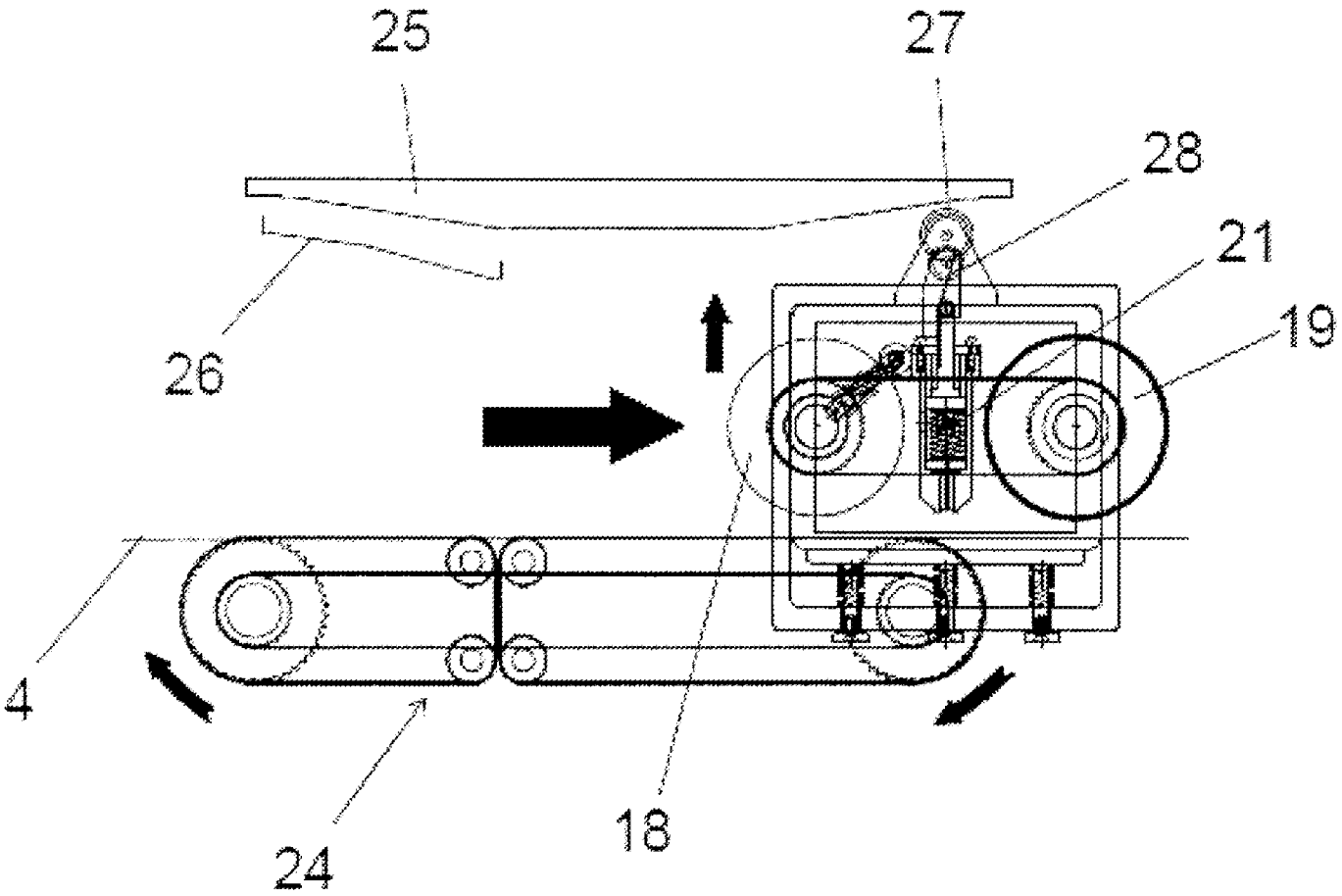

Then, the upper stop (27) of the carriage (16) moves up through the rear portion of the support ramp (25), whereby the carriage (16) is raised, the rollers (18 and 19) no longer pressing on the laminar strip resulting from joining the laminar strips (2 and 4), as seen in FIG. 5F. At this moment, braking is applied to the reel (3) until stopping it, and the remainder of the laminar strip (2) that had been cut is subsequently rewound, and this action can be seen in FIG. 2G.

Figure 5G:
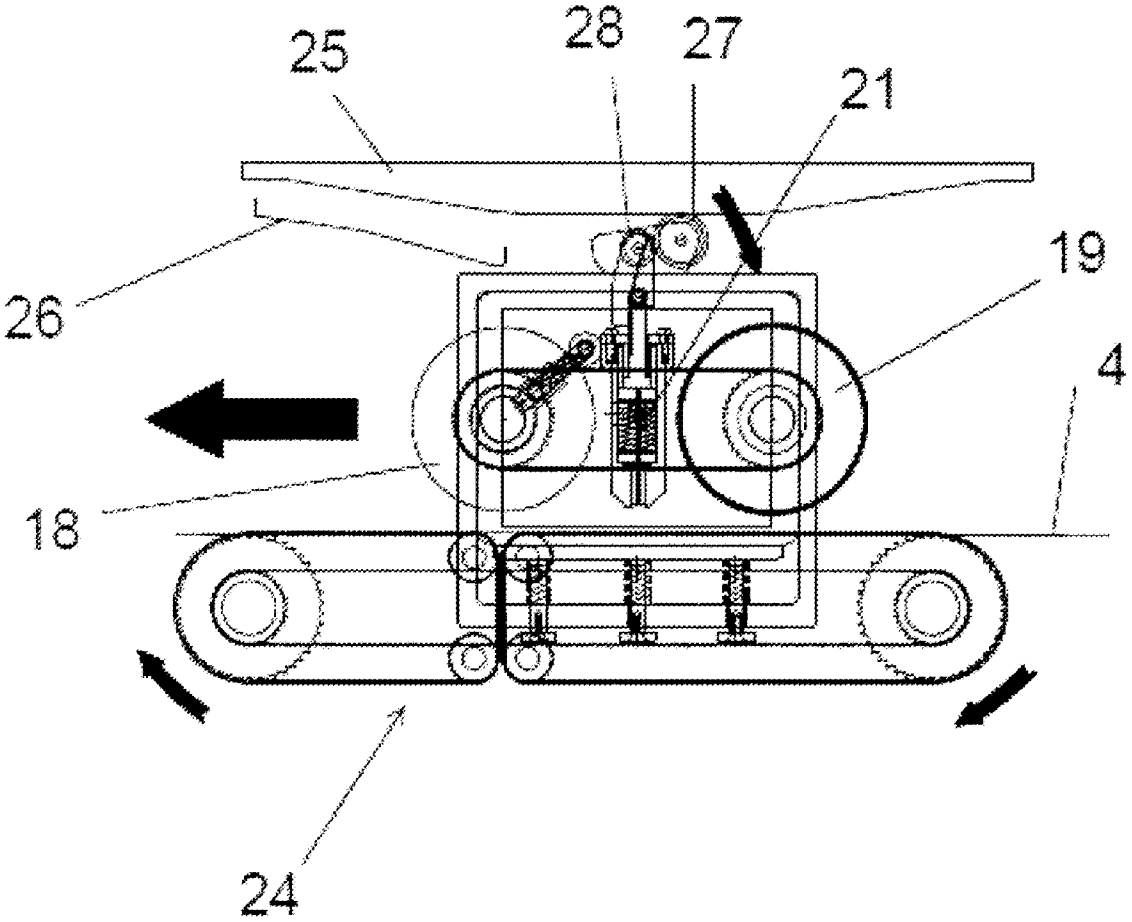
Figure 5H:
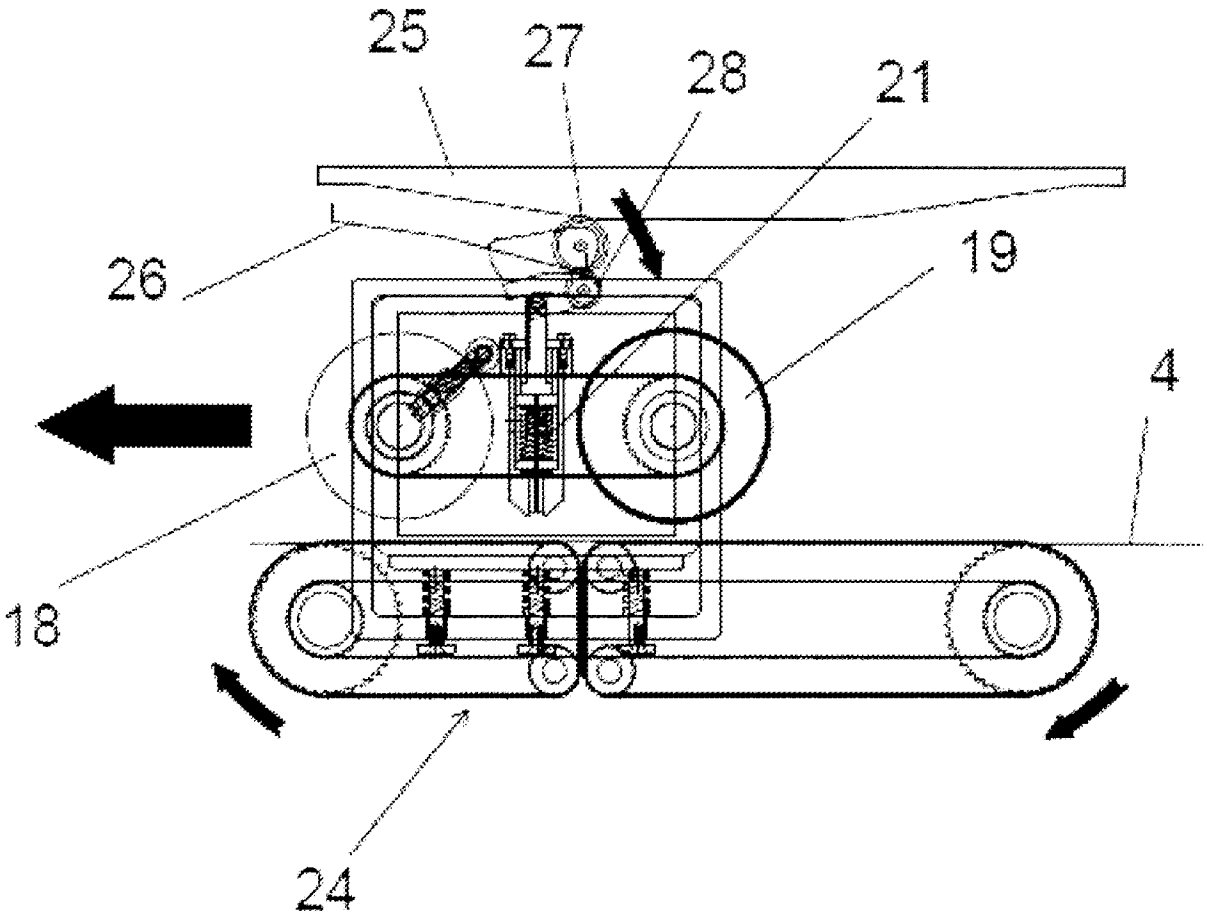
Figure 5I:
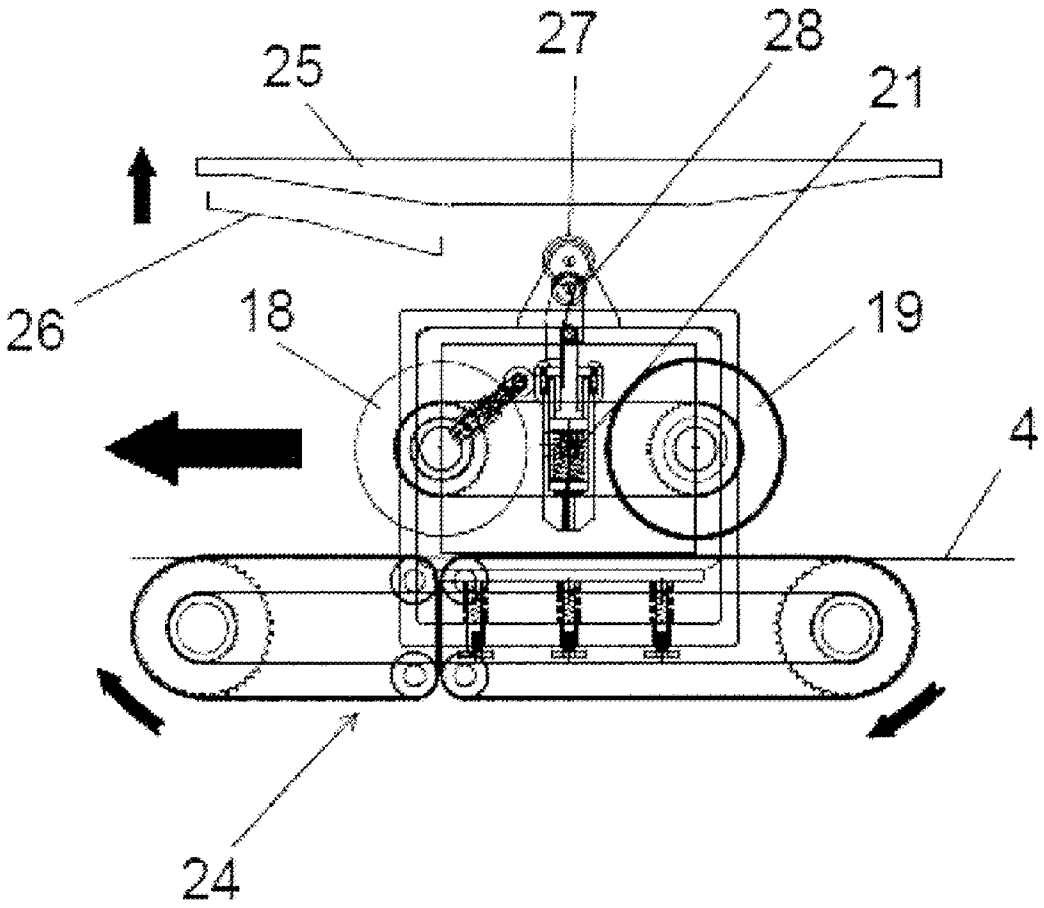
FIGS. 5I and 5J show in enlarged detail the return of the splicer head according to an embodiment different from the embodiment of FIGS. 5G and 5H of the preceding sequence.
Figure 5J:
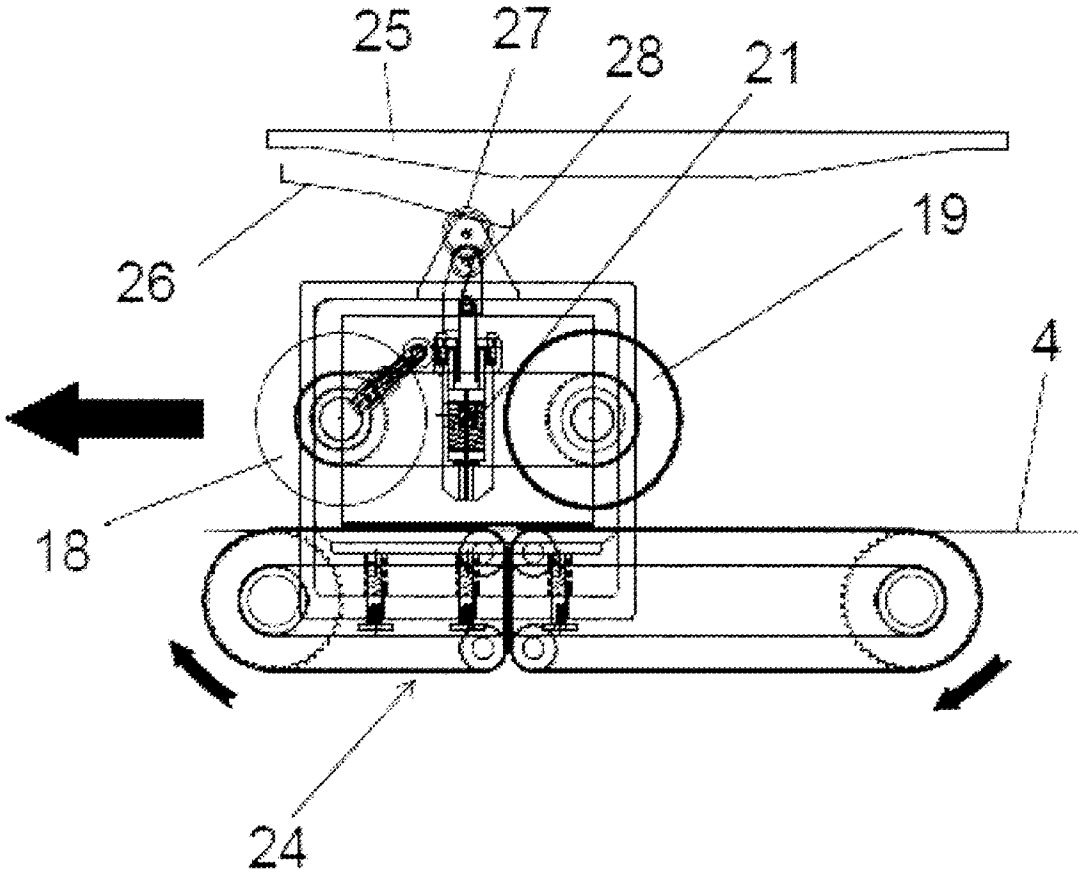

From the preceding situation the splicer head (8) can return in the opposite direction to the initial position, again having to pass below the ramps (25 and 26) such that, in order to prevent the rollers (18 and 19) or the cutting mechanism (21) from moving downwards in said return since they would interfere with the laminar strip (1) heading to the application process, an embodiment with the stops (27 and 28) in articulated assembly is envisaged, such that when reaching the ramps (25 and 26) in the return movement, said stops (27 and 28) pivot backwards, so they do not cause the carriage (16) and the cutting mechanism (21) to move downwards, as seen in FIGS. 5G and 5H.

Another solution to enable that return of the splicer head (8) without the rollers (18 and 19) and the cutting mechanism (21) moving downwards is shown in 5I and 5J, with the ramps (25 and 26) arranged in an upward movement assembly synchronized with the return movement of the splicer head (8) such that upon raising said ramps (25 and 26), the stops (27 and 28) do not contact same.

The invention claimed is:

1. An automatic splicer for providing a continuous supply of laminar strips, the automatic splicer comprising:

a reel holder adapted to hold a first reel holding a first laminar strip and a second reel holding a second laminar strip, wherein the reel holder can be selectively positioned among a feed position adapted to enable feeding of the first laminar strip of the first reel to an application process, a loading position adapted to enable loading of the second laminar strip of the second reel, and a standby position adapted to enable the feeding to continue when first laminar strip of the first reel runs out;

a variable-path storage adapted to hold at least one laminar strip; wherein the first and second laminar strips pass to the application process through the variable-path storage;

a guide rail mounted above the reel holder, the guide rail having a standby zone and a splicing zone;

a moveable splicer head mounted on the guide rail, the splicer head being adapted to move on the guide rail between the standby zone and the splicing zone, wherein while moving between the standby zone and the splicing zone the moveable splicer head passes between a lower support and a plurality of ramps located in an upper portion, the moveable splicer head being further adapted to splice the first and second laminar strips while the first and second laminar strips both move at a selected speed and the splicer head moves at a second speed greater than the selected speed, wherein the automatic splicer continues to provide a constant supply of laminar strips while the moveable splicer head splices the first and second laminar strips.

2. The automatic splicer for the supply of laminar strips according to claim 1, wherein the moveable splicer head comprises a body comprising a sliding assembly disposed on the guide rail, the body further comprising:

a plurality of springs; and a carriage disposed on the plurality of springs, the carriage being adapted to move vertically on the springs, the carriage having first and second rollers which are synchronized in rotational movement;

a cutting mechanism disposed between the first and second rollers, the cutting mechanism being adapted to move vertically on the body.

3. The automatic splicer for the continuous supply of laminar strips according to claim 2, wherein the carriage and the cutting mechanism of the moveable splicer head include respective stops, the respective stops being supported on the plurality of ramps while the moveable splicer head moves through the splicing zone, thereby forcing the carriage and the cutting mechanism to move downwards.

4. The automatic splicer for the continuous supply of laminar strips according to claim 3, wherein the respective stops of the carriage and of the cutting mechanism are arranged in an articulated assembly which allows them to pivot backwards during a movement of the moveable splicer head in order to overcome the plurality of ramps without forcing the carriage and the cutting mechanism to move downwards.

5. The automatic splicer for the continuous supply of laminar strips according to claim 1, wherein the lower support of the splicing zone comprises first and second consecutive continuous bands between which the cutting mechanism cuts the first laminar strip to enable splicing of the first laminar strip with the second laminar strip while the first reel and the second reel continue to move.

6. The automatic splicer for the continuous supply of laminar strips according to claim 1, wherein the plurality of ramps are arranged in an upward movement assembly synchronized with a movement of the moveable splicer head allowing the movement of the moveable splicer head without forcing the carriage and the cutting mechanism to move downwards.

7. The automatic splicer for the continuous supply of laminar strips according to claim 1, wherein a hinged ramp is arranged in relation with the reel holder for unloading a remainder of the first laminar strip of the first reel that runs out after the splicing of the first laminar strip with the second laminar strip.

8. The automatic splicer for the continuous supply of laminar strips according to claim 1, further comprising:

a rotatable reel holder adapted to hold the first reel holding the first laminar strip and the second reel holding the second laminar strip, wherein the rotatable reel holder is adapted to be rotated among the feed position, the loading position, and the standby position.

* * * * *